US005405487A

United States Patent [19]

Galchefski et al.

[11] Patent Number: 5,405,487

[45] Date of Patent: Apr. 11, 1995

[54] APPARATUS AND METHOD FOR APPLYING LABELS ONTO SMALL CYLINDRICAL ARTICLES AND WEB AND ADHESIVE DELIVERY MECHANISM

[75] Inventors: John M. Galchefski, Larksville, Pa.; Jan Westbury, Turlock, Calif.

[73] Assignee: CMS Gilbreth Packaging Systems, Inc., Trevose, Pa.

[21] Appl. No.: 115,433

[22] Filed: Sep. 1, 1993

Related U.S. Application Data

[63] Continuation-in-part of Ser. No. 906,573, Jun. 30, 1992, Pat. No. 5,350,482.

[51] Int. Cl.[6] ..... B65C 9/00

[52] U.S. Cl. ..... 156/566; 156/449; 156/456; 156/DIG. 31; 198/690.1; 221/212

[58] Field of Search ..... 156/215, 256, 281, 308.6, 156/308.8, 314, 446, 449, 450, 456, 520, 521, 86, 488, 566, 567, 568, 578, DIG. 31, DIG. 26; 198/468.5, 690.1; 221/211, 212, 214, 217

[56] References Cited

U.S. PATENT DOCUMENTS

| | | | |
|---|---|---|---|
| 2,703,660 | 3/1955 | Von Hofe et al. | 156/521 |
| 3,235,433 | 2/1966 | Cvacho et al. | 156/229 |
| 3,577,293 | 5/1971 | Ritterhoff | 156/156 |
| 3,604,584 | 9/1971 | Shank, Jr. | 215/12 R |
| 3,659,394 | 5/1972 | Hartleib et al. | 53/33 |
| 3,754,635 | 8/1973 | Mojden | 198/690.1 X |
| 3,765,991 | 10/1973 | Hoffmann | 156/521 |
| 3,834,963 | 9/1974 | Hoffman | 156/215 |
| 3,878,960 | 4/1975 | Jonsson et al. | 215/12 R |
| 4,108,709 | 8/1978 | Hoffmann | 156/446 |
| 4,108,710 | 8/1978 | Hoffmann | 156/480 |
| 4,108,711 | 8/1978 | Hoffmann | 156/497 |
| 4,124,433 | 11/1978 | Herdzina et al. | 156/456 |
| 4,207,832 | 6/1980 | Bowman et al. | 118/212 |
| 4,242,167 | 12/1980 | Hoffmann | 156/357 |
| 4,323,416 | 4/1982 | Malthouse et al. | 156/521 |
| 4,336,095 | 6/1982 | Hoffmann | 156/361 |
| 4,366,016 | 12/1982 | Golden, Jr. | 156/218 |
| 4,406,721 | 9/1983 | Hoffmann | 156/86 |
| 4,416,714 | 11/1983 | Hoffmann | 156/86 |
| 4,425,866 | 1/1984 | Hoffmann | 118/58 |
| 4,443,285 | 4/1984 | Roth et al. | 156/215 |
| 4,447,280 | 5/1984 | Malthouse | 156/85 |
| 4,496,409 | 1/1985 | Kontz | 156/85 |
| 4,500,386 | 2/1985 | Hoffman | 156/449 |
| 4,519,868 | 5/1985 | Hoffmann | 156/353 |

(List continued on next page.)

FOREIGN PATENT DOCUMENTS

| | | |
|---|---|---|
| 1012906 | 6/1977 | Canada . |
| 1106653 | 3/1968 | United Kingdom . |

*Primary Examiner*—David A. Simmons
*Assistant Examiner*—James J. Engel
*Attorney, Agent, or Firm*—Morgan & Finnegan

[57] ABSTRACT

An apparatus for applying a label onto a small, cylindrical article, such as a dry cell battery, is disclosed. A rotatable label transport drum has a central, horizontal axis. A label is fed to the drum surface, retained thereto as the drum rotates, and moved with the rotating drum into an article wrapping position defined at the upper area of the drum. An article delivery system, such as a star transfer wheel, delivers the articles sequentially onto the drum surface. The delivery system is spaced outward from the drum surface to clear the trailing edge of the label which is outwardly positioned from the drum surface. An attractive force is imparted on the article in a direction so as to aid smooth delivery of the article onto the drum surface and the label moving therewith. In one aspect of the invention, when the articles are magnetically attractive drycell batteries, at least one magnet retains the drycells against an article engaging surface of a pressure plate which defines an article entrance portion that is disposed downward to the drum surface so that the drycells are smoothly and tangentially transferred onto the drum surface. In another aspect of the invention, a web feed and cutting mechanism is disclosed. In still another aspect of the invention, an adhesive delivery system using a gravure roller is disclosed.

47 Claims, 18 Drawing Sheets

U.S. PATENT DOCUMENTS

| | | | |
|---|---|---|---|
| 4,526,645 | 7/1985 | Malthouse et al. | 156/350 |
| 4,544,431 | 10/1985 | King | 156/256 |
| 4,545,832 | 10/1985 | Hoffmann | 156/86 |
| 4,552,608 | 11/1985 | Hoffmann et al. | 156/351 |
| 4,574,020 | 3/1986 | Fosnaught | 156/80 |
| 4,604,154 | 8/1986 | Fosnaught | 156/264 |
| 4,629,528 | 12/1986 | Tanaka et al. | 156/354 |
| 4,632,721 | 12/1986 | Hoffmann et al. | 156/458 |
| 4,662,925 | 5/1987 | Thimons et al. | 65/104 |
| 4,671,836 | 6/1987 | Fumei | 156/215 |
| 4,686,931 | 8/1987 | Difrank | 118/50 |
| 4,693,210 | 9/1987 | Difrank | 156/259 |
| 4,694,633 | 9/1987 | Fujio et al. | 53/49 |
| 4,704,173 | 11/1987 | Hoffman | 156/86 |
| 4,724,037 | 2/1988 | Olsen | 156/578 |
| 4,726,872 | 2/1988 | Olsen | 156/455 |
| 4,729,811 | 3/1988 | Difrank | 156/449 |
| 4,735,668 | 4/1988 | Hoffmann | 156/215 |
| 4,749,428 | 6/1988 | Dickey | 156/215 |
| 4,761,200 | 8/1988 | Szeremeta | 156/448 |
| 4,772,354 | 9/1988 | Olsen et al. | 156/578 |
| 4,781,785 | 11/1988 | Szeremeta | 156/448 |
| 4,832,774 | 5/1989 | Difrank et al. | 156/215 |
| 4,844,760 | 7/1989 | Dickey | 156/215 |
| 4,844,957 | 7/1989 | Hoffman | 428/34.7 |
| 4,923,557 | 5/1990 | Dickey | 156/86 |
| 4,931,122 | 6/1990 | Mitchell | 156/215 |
| 4,977,002 | 12/1990 | Hoffman | 428/34.7 |
| 4,984,413 | 1/1991 | Cosmo | 53/465 |
| 5,037,499 | 8/1991 | Bright et al. | 156/456 |
| 5,045,140 | 9/1991 | Dickey | 156/215 |
| 5,078,826 | 1/1992 | Rogall | 156/451 |
| 5,091,040 | 2/1992 | Otruba | 156/566 |
| 5,091,239 | 2/1992 | Przeworski et al. | 428/195 |
| 5,116,452 | 5/1992 | Eder | 156/566 |

APPARATUS AND METHOD FOR APPLYING LABELS ONTO SMALL CYLINDRICAL ARTICLES AND WEB AND ADHESIVE DELIVERY MECHANISM

This application is a continuation-in-part application of U.S. patent application Ser. No. 07/906,573, now U.S. Pat. No. 5,350,482, filed Jun. 30, 1992, entitled "Apparatus and Method for Applying Labels Onto Small Cylindrical Articles", which is hereby incorporated by reference.

FIELD OF THE INVENTION

This invention relates to an apparatus and method for applying a label onto a small, cylindrical article by smoothly and tangentially delivering the articles onto a label transport drum for wrap around labeling of the article.

BACKGROUND OF THE INVENTION

In copending parent patent application Ser. No. 07/906,573 filed Jun. 30, 1992, small articles such as drycell batteries, lipstick containers, lip balm containers and the like are labeled with high quality, thin film polymeric labels. A strip of label material is fed to a label transport drum, which has an outer surface with a plurality of predetermined label areas on which labels are retained as the drum rotates. The labels are initially fed as a strip onto the drum surface, and then cut on the drum surface into labels of predetermined size.

As each label moves with the rotating drum in its respective label area, an adhesive is applied onto the area adjacent the leading edge of the label to give the leading edge a tacky quality to the edge. A predetermined amount of solvent is evenly applied onto the area adjacent the trailing edge of the label so as to dissolve a portion of the treated surface of the label. The label moves to an article wrapping position where small articles, such as drycell batteries, are wrapped, securing first the leading edge to the article, followed by overlapping the trailing edge onto the leading edge so that the solvent positioned on the trailing edge of the label creates a solvent-seal bond. The labels are then heat shrunk over the articles. The apparatus provides for high quality cylindrical labeling of small articles such as drycell batteries using thin film, polymeric labels, e.g., typically less than 0.0035" thickness.

As disclosed in the copending parent application, a predetermined amount of solvent is applied to the area adjacent the trailing edge of the label by rotating a wiper member at a surface speed different from the speed of the label transport drum. The speed differential between the wiper tip and drum has been found to aid in applying solvent in a predetermined pattern on the trailing edge of the smaller labels used for wrap around labeling of small cylindrical articles such a drycell batteries. It has been found advantageous to use a maximized speed differential by controlled application of solvent through a static wiper spaced from the drum periphery. The use of a static wiper, however, requires some means for positioning the trailing edge of the label outward from the drum periphery to engage the outwardly spaced static wiper member.

Protrusions, ridges and other similar means could be used to position the trailing label edge outward from the drum surface to engage an outwardly positioned static wiper. In this construction, however, any article delivery mechanism, such as a chain conveyor or star wheel assembly, must have its article discharge area spaced outward from the drum surface so that the delivery mechanism will not engage the outwardly positioned trailing edge and interfere with labeling. This spacing creates a "drop-off" from the delivery mechanism onto the drum surface. This drop-off could pose problems in article delivery onto the label transport drum for wrap around labeling because the articles should desirably be fed tangentially and smoothly onto the surface of the drum without interfering with the label.

When labeling larger articles where the trailing edge is positioned outward from the drum periphery, such as sometimes occurs when labeling commercially available soft drink containers or large metallic cans, this drop-off is not critical to labeling quality because the containers are typically lightweight compared to their size, and often the desired label quality often is not high. The drop-off is relatively unnoticed.

With smaller cylindrical articles, the drop-off would be more pronounced compared to the size of the label and article. The drop-off makes labeling of these smaller articles more difficult because the smaller article drops onto the drum surface, instead of being tangentially and smoothly delivered thereon. In some cases, where the article drops onto the drum, the article becomes skewed relative to the label, resulting in poor quality labeling.

When the smaller article is a dry cell, such as formed from a metallic casing, the relative difficulty of labeling is increased even more. Typically, these metallic articles, such as drycell batteries, are heavier than other articles of similar size, making the articles more difficult to label correctly. This labeling difficulty could be even more pronounced when the heavier articles engage a pressure plate that is used for guiding the articles against the label transport drum. When using a pressure plate, it is more desirable to move the articles in tangential, spinning engagement between the pressure plate and the drum surface. This is made even more difficult by the drop-off from the delivery mechanism onto the drum.

The copending parent application also discloses a rotary pad print head for applying a cold adhesive onto the leading edge of a label. As the printhead rotates, an adhesive print pad engages a gravure roller having adhesive applied thereto. The print pad preferably rotates at the same surface speed as the drum and is timed so that the pad prints the adhesive onto the area of the label adjacent the leading edge.

It has been proposed to apply adhesive to the gravure roller by means of a dip bath where a portion of the gravure roller is immersed in a bath of cold adhesive. As the gravure roller rotates, it picks up adhesive from the bath. A doctor blade then removes excess adhesive.

The cold adhesive is viscous and difficult to control, and a dip bath was seen as one means to supply this viscous adhesive onto the gravure roll for transfer to the print pad. This system, however, can cause unwanted adhesive splashing and dripping, and an uncontrolled adhesive feed onto the gravure roller. The adhesive in the delivery lines and possibly the adhesive in the dip bath also can become stagnant, especially during slow production periods, making the already viscous adhesive even more difficult to control.

An adhesive system, which feeds adhesive directly onto the gravure roller, such as a reciprocating pump, also can become stagnant when production has slowed or stopped altogether. It would be more desirable to supply the cold adhesive in a more controlled manner onto the gravure roll as well as provide a means for minimizing stagnation of the cold adhesive in the delivery lines when production has slowed.

Additionally, it has been found that cutting on the label transport drum, such as disclosed in the copending, parent application, is not as desirable as heretofore believed when labeling small, cylindrical articles typically under about 1.75 inches diameter with small, thin film polymer labels. Poor film cutting can occur when cutting on-drum. On-drum cutting may also be more difficult if the area of the drum surface where the trailing edge of a label lies is positioned generally outward from the drum surface for engaging a fixed wiper. This outwardly extended area on which the trailing edge rests would receive the cutting blade, and thus, cutting on this raised surface could create inaccurate cutting. A separate cutting element that is positioned on the drum surface would also interfere with subsequent labeling because the article would have to roll up and over the drum positioned cutting element, making labeling of a small article difficult.

It is proposed to use off-drum cutting so that cutting on the label transport drum is no longer required. Off-drum cutting, however, requires precise placement of cut labels onto predetermined label areas defined on the drum surface so that leading and trailing edges are accurately positioned to ensure precise high quality labeling. It has been found that a cutting drum which is positioned close to the peripheral surface of the label transport drum provides for adequate off-drum cutting. For smaller cut labels, such as used with dry cell batteries, it has been found that the cutting drum should be as close as 0.010 to about 0.050 inches and preferably as close as 0.010 to 0.025 inches to ensure adequate transfer of the label onto the label transport drum at high operating speeds. If the cutting drum were positioned a greater distance from the label transport drum, the light weight, small label may not transfer properly.

These close distances, however, are unobtainable with many conventional cutting apparatus when the label transport drum includes structure for positioning the trailing edge of a label outward from the drum surface a sufficient distance to engage a static wiper. This positioning structure could extend as far as 0.040 or more inches from the drum periphery. This distance is necessary to ensure proper label engagement with a wiper, and sufficient clearance between the wiper and peripheral surface of the label transport drum. As the label transport drum and cutting drum rotate, the positioning means could violently engage the cutting drum during high speed operation, causing label misplacement during label transfer onto the label transport drum.

Small differences in web feed, sometimes as little as one-sixteenth of an inch, also could cause improper film positioning during cutting, thus creating an inaccurate cut point. As a result, the printed indicia and other identifying logos or indicia on the cut labels would be improperly aligned. It is necessary then, to ensure precise off-drum cutting on a cutting drum and subsequent, accurate transfer of cut labels onto the label transport drum for wrap around labeling of small cylinder articles, which typically are less than about 1.75 inches diameter.

SUMMARY OF THE INVENTION

It is therefore an object of the present invention to deliver from an article delivery mechanism spaced outward from a label transport drum small cylinder articles that are less than about 1.75 inches into tangential and smooth engagement with a label transport drum.

It is another object of the present invention to assist small cylinder, magnetically attractive articles, such as dry cell batteries, tangentially and smoothly onto a label transport drum.

Another object of the present invention is to deliver small cylinder, magnetically attractive articles, such as formed from a metal casing as used in dry cell batteries, tangentially and smoothly onto a label transport from a position spaced outward from the drum surface.

Still another object of the present invention is to deliver small cylinder articles tangentially and smoothly onto a label transport drum from a star transfer wheel spaced outward from the drum surface.

It is yet another object of the present invention to deliver a viscous cold adhesive onto the print pad of a rotary pad printhead from a gravure roller without having the adhesive become stagnant such as during slow production periods.

Yet another object is to feed in a controlled manner a cold adhesive onto a gravure roll for subsequent transfer to the print pad of a rotary pad printhead.

It is another object of the present invention to cut continuously fed film off-drum into precise, small labels while accurately transferring the labels onto predetermined label areas of a label transport drum.

Yet another object of the present invention is to cut film strip into labels on a cutting drum that is positioned adjacent to a label transport drum where the label transport drum includes means for positioning the trailing edge of the label outward a distance greater than the distance between the label transport and cutting drums while precisely transferring the label onto the label transport drum.

In accordance with one aspect of the present invention, labels are applied onto small cylindrical articles such as drycell batteries. A label transport drum defines a central, preferably horizontal axis and is rotated about its axis. A label feed mechanism feeds a label to the surface of the drum. The label is retained to the drum surface as the label moves with the drum into an article wrapping position. In one aspect of the present invention, the trailing edge of the label is positioned outward from the drum periphery for engaging a static wiper by means of a biased plunger contained in the drum surface which exerts pressure against the trailing edge to position the trailing edge of the label a spaced distance from the periphery of the drum.

An article delivery mechanism is spaced outward from the drum surface to clear the outwardly positioned trailing edge, thus creating a drop-off from the article discharge area onto the drum surface. The mechanism delivers small cylindrical articles, such as magnetically attractive drycell batteries, onto the drum and into rotative engagement with the label as the label moves into the article wrapping position. During article delivery, an attractive force is imparted against the article in a direction to aid in smooth, tangential delivery of the article onto the label transport drum. The imparted force can be generated from a vacuum, magnetism (if the article is magnetically attractive) or other means. If the article is made of plastic or other similar non-magnetic material, a strong vacuum draw could be adequate to impart the attractive force necessary to aid in smooth, tangential delivery.

In one aspect of the invention, the articles are dry cells and magnetically attractive. A magnet is spaced outward from the label transport drum, and positioned on the article delivery mechanism for imparting magnetic forces on the article in a direction away from the label transport drum to aid in smooth, tangential delivery of articles onto the drum surface and into engagement with a label positioned at the article wrapping position.

In another aspect of the present invention, a pressure plate has a lower article engaging surface which is spaced outward from the drum surface so as to engage and retain articles on the drum surface as the articles move between the article engaging surface and the drum surface. The article engaging surface defines an article entrance area that is dimensioned larger than the diameter of the articles. The article entrance area is positioned adjacent to the article discharge area of the article delivery mechanism so that the articles are delivered into the defined article entrance area upon discharge. The article engaging surface is disposed downward toward the drum surface.

In another aspect of the invention, during article delivery into the article entrance area, the imparted force retains the article onto the article engaging surface until the article smoothly and tangentially engages the drum surface. The lower article engaging surface is curved outward from the drum surface at the article entrance portion to aid in imparting rotative spin to the article as the article initially engages the article engaging surface.

In another aspect of the invention, the article delivery mechanism comprises a star transfer wheel mounted adjacent to the label transport drum and article entrance area. The star transfer wheel has at least one article receiving position with at least one magnet positioned therein. The article is released from the star transfer wheel into the article entrance area defined between the pressure plate and the drum surface. The outwardly projecting portion of the star transfer wheel pushes the article into that area as the star transfer wheel rotates. The exerted forces on the article retain the article against the inclined lower surface of the pressure plate while the article moves therealong until the article tangentially engages the drum surface, thus providing smooth delivery thereon. When the article is magnetically attractive, at least one magnet is positioned in each article receiving portion of the star transfer wheel to generate attractive forces onto the drycell and retain the drycell onto the lower article engaging surface of the pressure plate.

In accordance with another aspect of the present invention, a cold adhesive is controllably delivered onto a print pad of a rotary pad printhead without undue adhesive spillage while ensuring the adhesive does not become stagnant in the adhesive delivery lines. The adhesive application system includes a rotary pad printhead that is timed to rotate at substantially the same surface speed as the surface speed of the label transport drum. The printhead includes at least one print pad that engages the area adjacent the leading edge of the label to print an adhesive onto the leading edge.

An adhesive distribution block has a gravure roller rotatably mounted adjacent thereto. The adhesive distribution block includes an arcuate pocket dimensioned to engage the arcuate surface of a portion of the gravure roller, and an adhesive channel extending through the block for receiving adhesive. The channel forms a slot opening with the arcuate pocket so that the peripheral surface of the gravure roller engages the slot opening and the adhesive is delivered to the peripheral surface of the gravure roller.

The adhesive distribution block and gravure roller are positioned adjacent the printhead so that the print pad engages the surface of the gravure roller as the printhead rotates. The gravure roller may be direct driven from the label transport drum. The rotary pad printhead can be driven from the label transport drum or the gravure roller, and preferably includes a shaft and clutch mechanism for disengaging the print head from engaging the gravure roller and label transport drum when labels are not fed but the drum is rotating.

A closed container holds the cold adhesive, and includes an adhesive discharge line which communicates with the adhesive channel of the distribution block. The closed tank is sufficiently pressurized to permit adhesive flow from the closed container into a feed line to the distribution block. Adhesive is returned from the distribution block to another container. In one aspect of the present invention, the pocket of the adhesive distribution block includes a beveled edge portion that engages the gravure roller to act similar to a doctor blade so as to wipe excess adhesive from the gravure roller.

In accordance with another aspect of the present invention, a continuous length of label film has indicia defining leading and trailing edges of labels. The film is fed from a supply roll onto the surface of a cutting drum that defines a label transfer area spaced adjacent to the label transport drum. The cutting drum includes an outwardly extending cutter blade for engaging a stationary blade at a defined cut point, and a relief portion adjacent and before the cutter blade. As the cutting drum rotates, the cutter blade engages a stationary blade at a cut point corresponding to the position of the stationary blade. The cut point is positioned an arcuate distance from the label transfer position less than the length of the label to be cut so that the film area corresponding to the leading edge of the label is initially transferred onto the label transport drum before cutting. In one aspect of the invention, the leading edge of a label is initially transferred before label cutting.

The speed of the advancing film is synchronized with the rotating speed of the label transport drum so that indicia defining respective trailing edges of labels are sequentially positioned at the cut point as the cutting drum rotates while the leading edge of the label is being transferred onto the label transport drum. The film is cut at the cut point to form a cut label which is then sequentially transferred onto the label transport drum as the label moves with the cutting drum.

The trailing edge of the label is positioned outward from the label transport drum by means of an outwardly projecting portion of the label transport drum, which in one aspect of the invention is a biased plunger. Just prior to film cutting, the plunger moves into the relief portion, thus preventing cutting drum interference with the outwardly biased plunger, but allowing close positioning of the label transport and cutting drums. Rotational engagement of the plunger and cutting drum is prevented by means of a relief positioned in the cut drum immediately prior to the rotating blade. After the rotating blade severs the web it rotates toward the periphery of the wrap drum. As the wrap drum rotates, the raised plunger enters the relieved area of the cut drum to prevent contact between both rotating members.

An adhesive is applied onto the area adjacent the leading edge of the label. A solvent is wiped onto the area adjacent the trailing edge of the label by engaging the outwardly positioned, trailing label edge with a wiper spaced outward from the drum surface so that a predetermined amount of solvent is wiped onto the area adjacent the trailing edge of the label when the trailing edge of the label engages the wiper during drum rotation.

Small cylindrical articles are delivered into tangential spinning engagement with the surface of the drum and into rotative engagement with the leading edge of the label as the label is moved into an article wrapping position and into engagement with the rotating article so that the label wraps about the article. In one aspect of the invention, the articles are magnetically attractive and magnetic forces are imparted onto the article in a direction such as to aid in smooth, tangential deliverance of the article onto the drum surface and into engagement with a label positioned at the article wrapping position.

In another aspect of the present invention, the indicia corresponding to the trailing and leading edges of the label are sensed at a predetermined distance from the cut point. The rotating speed of the label transport drum and the position of the label areas relative to the label transfer area are determined and the film speed onto the rotating cutting drum is regulated so that the indicia corresponding to the trailing edges of labels aligns with the cut point during cutting as the film advances.

In another aspect of the invention, the film is advanced onto the cutting drum at a slower surface speed than the surface speed of the cutting drum. The film is unwound from a label supply roll and fed through a dancer roll assembly having at least one dancer roll movable with changes in the speed of the film fed onto the cutting drum. The film unwinding speed is changed based on dancer arm movement to maintain constant tension on the film as it is withdrawn from the label supply roll. Air is blown from the cutting drum onto the cut labels toward the label positioned on the label transport drum as the cut labels move with the cutting drum into the label transfer position. The film is advanced onto the cutting drum the distance of one cut label length for each revolution of the cutting drum.

DESCRIPTION OF THE DRAWINGS

The foregoing and other objects and advantages of the present invention will be appreciated more fully from the following description, with references to the accompanying drawings in which.

FIG. **21*a*** is a schematic side elevation view of the third star transfer wheel and the pressure plate showing vacuum draw for imparting attractive forces against the articles.

Figure 22:
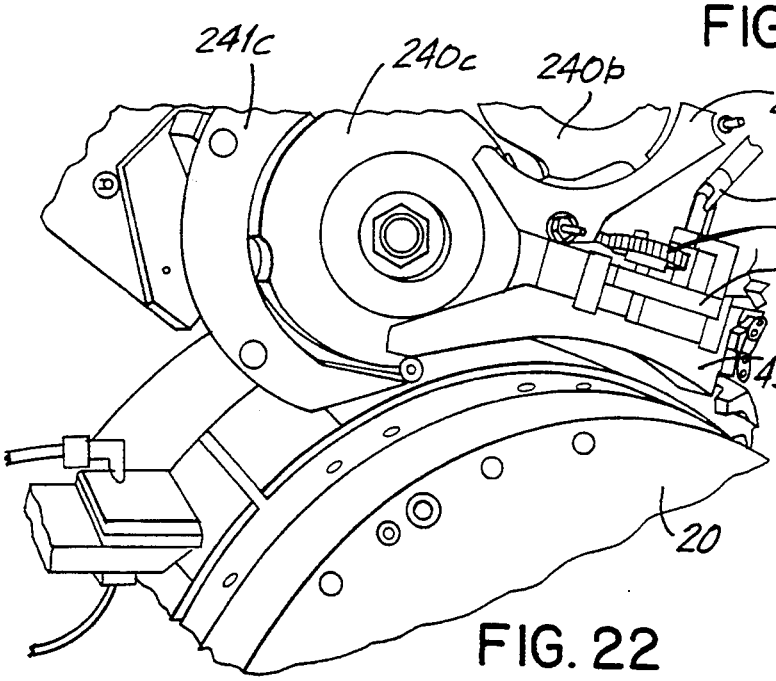

FIG. 22 is an isometric, schematic view of the label transport drum showing an article delivered onto the drum surface.

Figure 23:
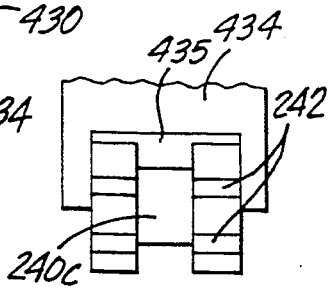

FIG. 23 is a schematic plan view of the pressure plate and star transfer wheel.

Figure 24:
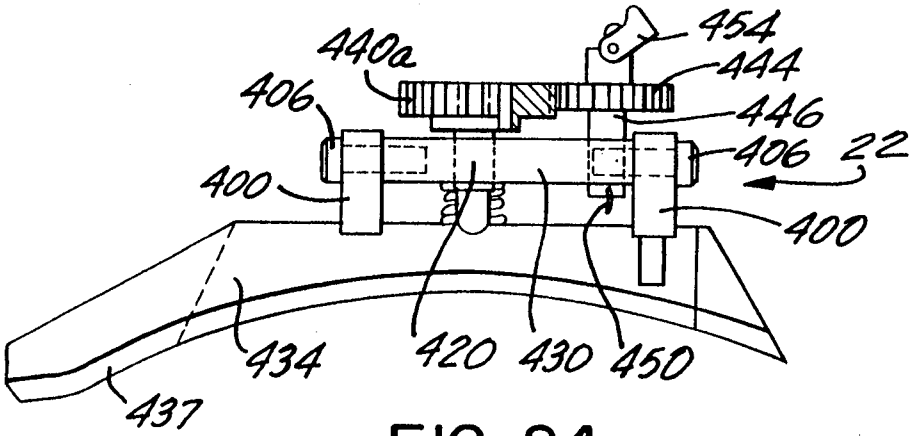

FIG. 24 is a side elevation view of the pressure applicator assembly using intermeshing spur gears connected to a control rod for controlling pressure plate bias against articles.

Figure 25:
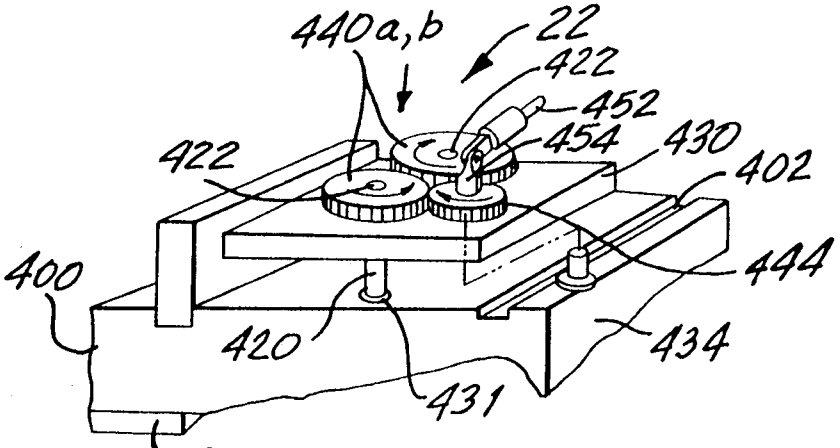

FIG. 25 is a pictorial view of a portion of the pressure plate and support plate showing in detail the gearing mechanism for moving the threaded rods against the pressure plate.

Figure 26:
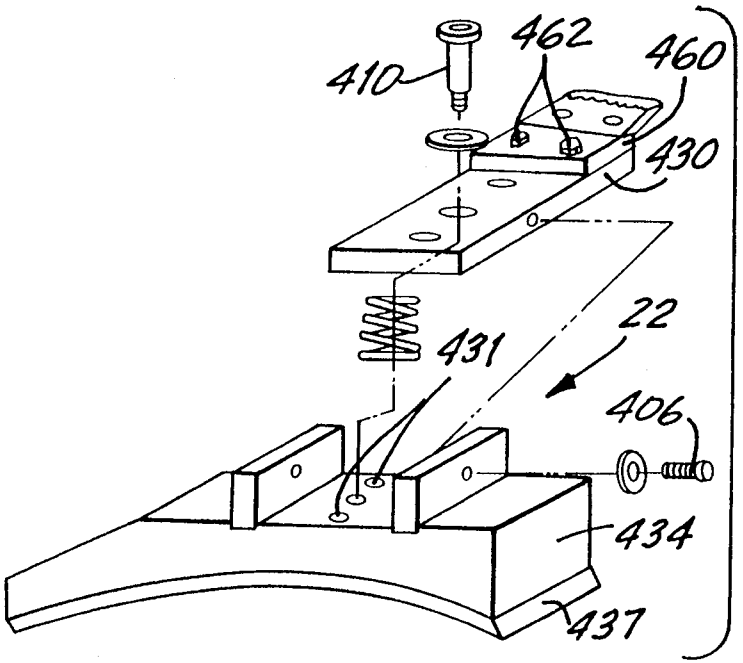

FIG. 26 is a schematic, exploded isometric view showing the relationship of the support and pressure plates.

Figure 27:
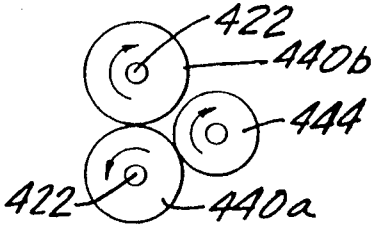

FIG. 27 is a schematic view showing the layout of the gear mechanism on the support plate.

Figure 28:
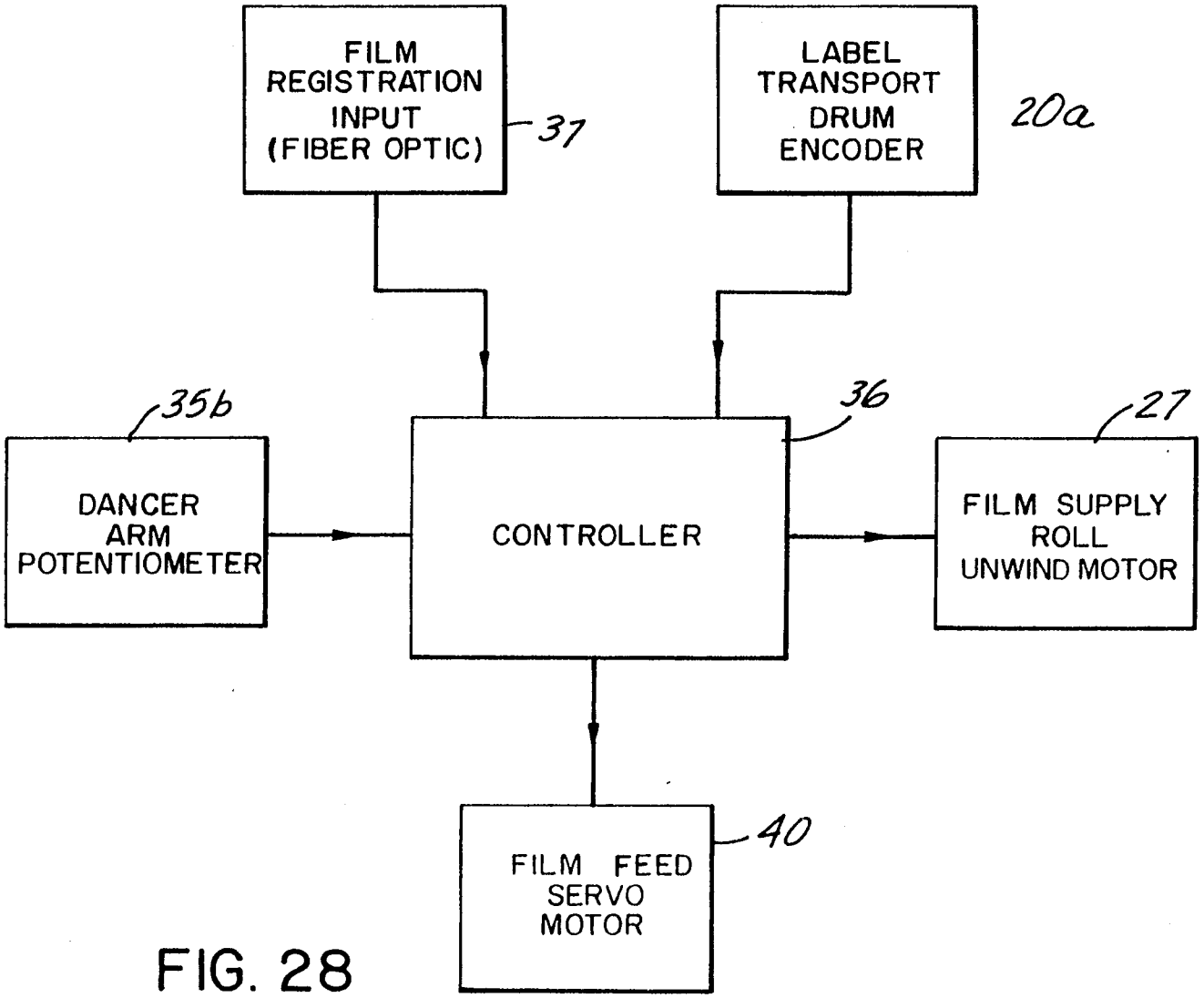

FIG. 28 is a block diagram showing the interrelation among the controller, encoder, sensors and film feed mechanism.

Figure 29:
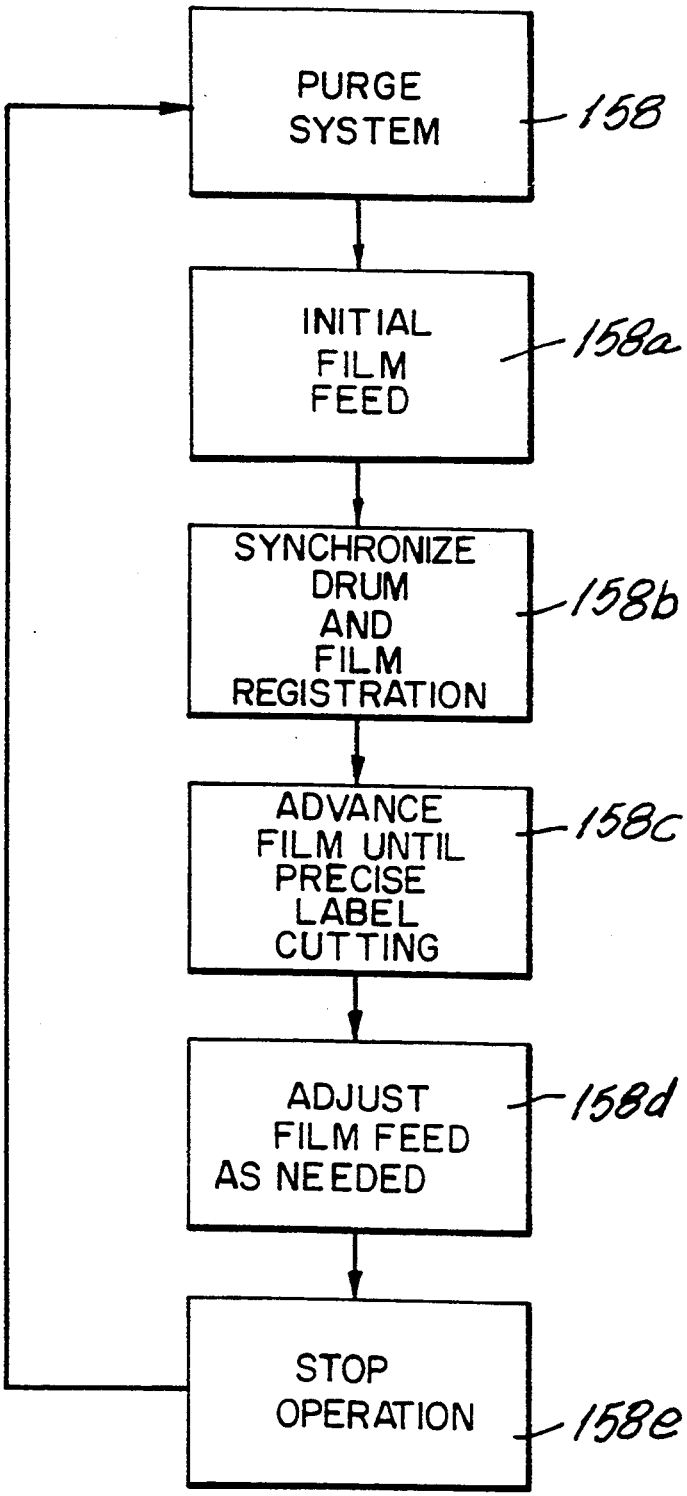

FIG. 29 is a flow chart showing the overall basic operation of the film feed mechanism.

Figure 30A:
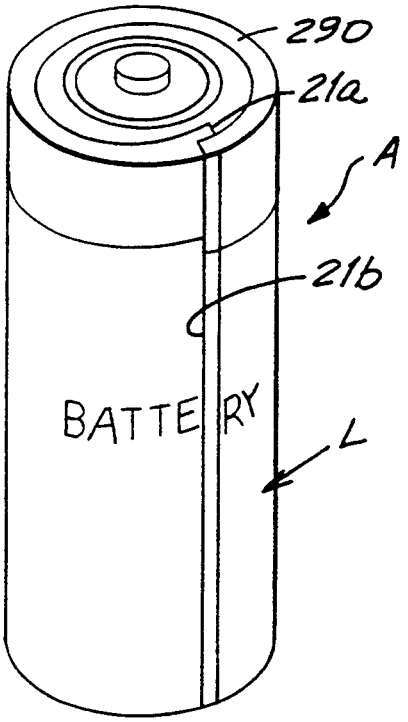

FIG. 30A is a pictorial view of a drycell battery showing an improperly aligned label applied thereto.

Figure 30B:
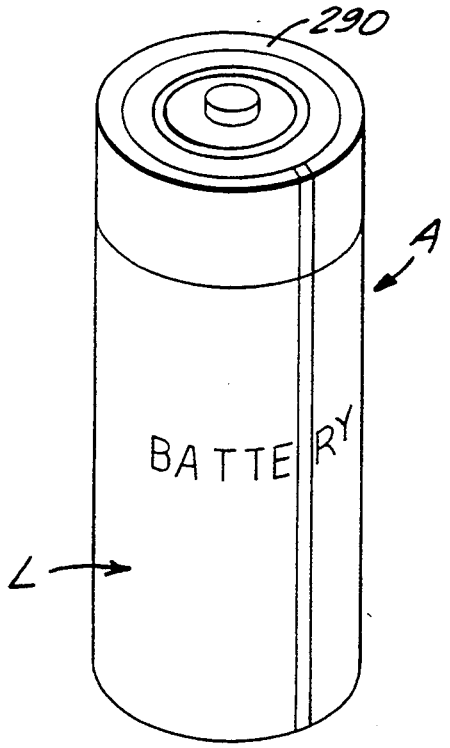

FIG. 30B is a pictorial view of a drycell battery showing a properly matched and aligned label.

Figure 31:
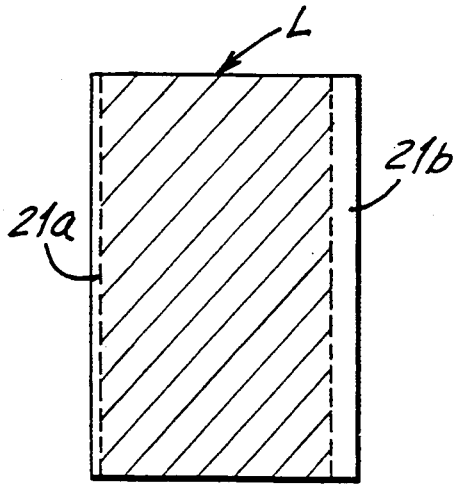

FIG. 31 is a plan view of the label to be applied to a small article showing leading and trailing edges in the areas adjacent the areas where printed matter and adhesives, as well as solvents are applied.

Figure 32:
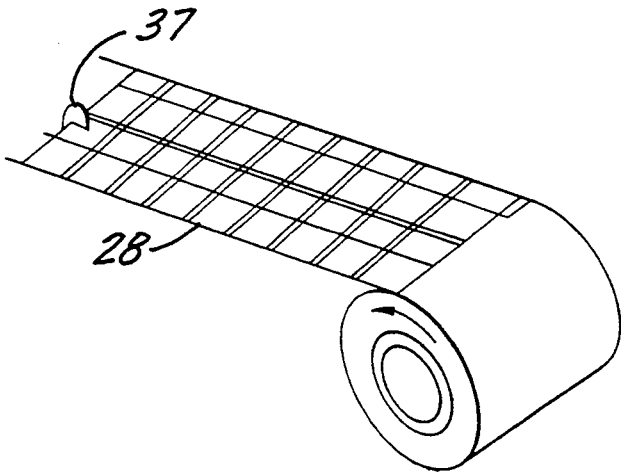

FIG. 32 is a pictorial view of a dual printed roll of label material used for labeling drycell batteries.

DETAILED DESCRIPTION OF THE INVENTION

The present invention includes an apparatus and method for applying a label onto a small cylindrical article such as a dry cell battery. In one aspect of the present invention, a label transport drum defines a central horizontal axis and is rotated about its axis. A cut label is supplied onto the surface of the drum. An article is delivered from an article delivery mechanism that is spaced outward from the drum surface such that the article would drop-off from the article delivery mechanism onto the drum. To prevent a sudden, possibly violent drop-off onto the drum surface that disrupts high quality labeling, attractive forces are exerted onto the article in a direction such that the article is tangentially and smoothly delivered onto the drum and into rotative engagement with the label as the label moves into an article wrapping position. In the case of dry cell batteries, the attractive forces are magnetic forces. In the case of plastic articles, the attractive force can be vacuum based other means for imparting an attractive or other force on the article can be used as becomes known to those skilled in the art.

In one aspect of the invention, the article delivery mechanism is a star transfer wheel having an article engaging pocket with at least one magnet for retaining a drycell battery or other similar magnetically attractive article thereto until the drycell is stripped from the lower article engaging surface of a pressure plate onto the label transport drum. The pocket edge pushes the article along the lower surface of the pressure plate which is disposed toward the drum surface. The magnet retains the article on the lower surface of the pressure plate as it moves therealong, until the drycell tangentially and smoothly engages the label transport drum.

Figures 1, 1A:
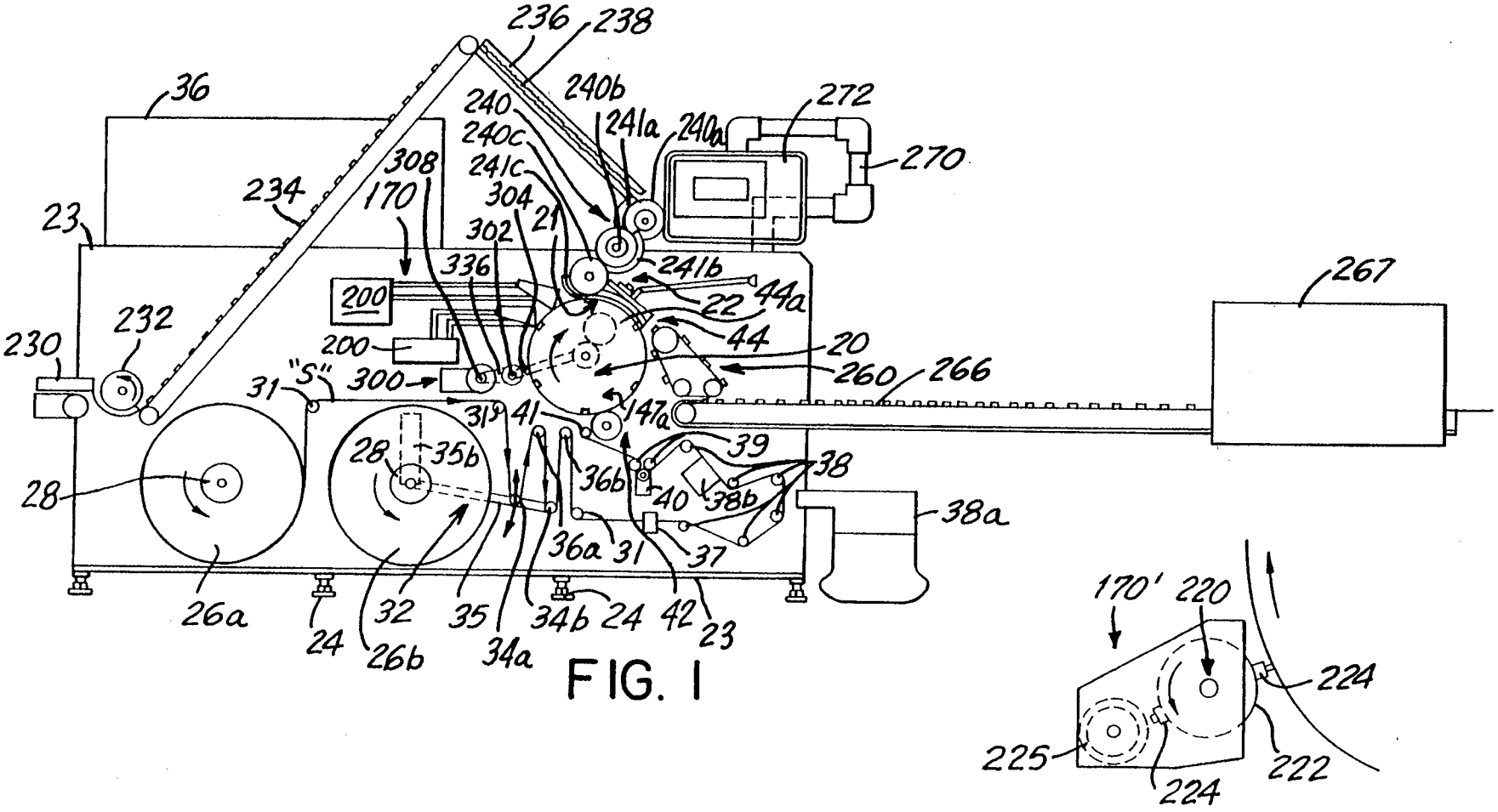
FIG. 1 is a schematic side elevation view of the apparatus that applies labels onto small cylindrical articles in accordance with the present invention.
FIG. 1A is a schematic illustration of another embodiment of a solvent wiper assembly mounted for rotation adjacent the label transport drum.

Referring now to FIG. 1, there is illustrated at 10 a schematic illustration of an apparatus for applying high quality, heat shrinkable, thin film polymeric labels to small, cylindrical articles typically less than about 1.75 inches in diameter while forming seams of high quality. Throughout this description and in the drawings, the cut labels will be referred to by the letter "L." In accordance with the present invention, labeling of small cylinder, magnetically attractive articles, such as those articles formed from a metallic casing (such as dry cells), can now be accomplished with even higher quality seams than was known before. Unless otherwise noted, the description will proceed by describing labeling of drycell batteries.

The apparatus 10 is suitable for high quality cylindrical labeling of small cylindrical articles, and most notably, magnetically attractive, cylindrical articles which typically have a much greater mass than those small cylindrical articles formed from lightweight materials, such as plastic tubes. All these articles, however, require thin film labels, typically having a thickness less than 0.0035 inches. Although in this description we will refer to the labeling of drycell batteries, the described apparatus will be used for wrap around labeling of many different types of small, cylindrical articles, and most notably, those heavier small cylindrical articles such as metallic lipstick containers, cylindrical, powdered metal products, and many others similar, heavy, metallic articles that are magnetically attractive and can be assisted into tangential, smooth delivery onto the surface of the label transport drum. Throughout the description and drawings, the small cylindrical articles will be referred to as dry cells, and will be given the reference letter "A".

The label material is preferably formed from a heat shrinkable, thin film polymer label material. Examples of acceptable film materials include those formed from polyvinyl chloride, polyester, and polystyrene. The label material typically has a thickness under 0.0035 inches, a thickness corresponding to the thinner label material thickness commonly used for labeling smaller cylindrical articles such as drycells, lip balm and other similar containers.

Typically, the drycells to be used with the present apparatus are about 1.75 inches in diameter or less, corresponding to the diameter of a "D" size (about 1.5 inches diameter) or smaller drycell. For purposes of understanding and description in this application, the size of the articles are described relative to an "AA" size battery, (slightly greater than 0.5 inch diameter and about two inches long, and weighing approximately 0.5 ounces). Any dimensions used with the associated components of the apparatus 10 are designed for use with labeling a small "AA" size battery. Typically, the labels used for wrapping this small size drycell are about 49×49 mm square (about 2.0×2.0 inches).

Because of the demanding label and seam quality requirements necessary for labeling these smaller drycells ("D" size or less), the labels L heretofore have been pre-seamed on a continuous basis, and then applied as a sleeve to the article. With conventional sleeve technology where the sleeve is first formed on a mandrel and then transferred to an article, a typical article size ranged in size usually less than two inches diameter and typically less than 1.75 inches diameter. Thus, heretofore, smaller articles, such as the described drycell batteries, had to be used as a mandrel and a sleeve placed thereover, or some other labeling method used besides wrap around.

The apparatus 10 is used for wrapping a label around a large variety of different small articles A requiring high quality labels, such as the described drycell batteries, lip balm containers, lipstick tubes and other similar articles where consumer confidence and expectations for the product are high. Such high quality labeling requires end-to-end label alignment on the articles A without mismatching, so that different colored zones, lettering, and trade logos printed on the label are aligned correctly after the article is wrapped. A pressure applicator, indicated at 22, provides a biasing force against the articles for wrapping, and has means for changing the biasing force exerted against selected sides of the article so as to aid in correct label alignment.

Additionally, the construction of the label transport drum, (which is indicated generally at 20), provides proper control over label retention, label movement with the drum, leading edge label transfer to an article at an article wrapping position, (indicated generally at 21, FIGS. 1 and 2), and label blow-off necessary to insure high quality labeling of small cylindrical articles such as drycell batteries with heat shrinkable, polymeric film labels.

The label transport drum 20 in the illustrated embodiment is a six pitch drum of about 54 inch circumference and has six predetermined label areas spaced about nine inches apart which receive labels for adhesive and solvent application and wrap around labeling. This configuration is beneficial for use with labels that are about four and a half inches or less long, corresponding to labels for wrapping drycell batteries that are "D" size or less.

Figure 3:
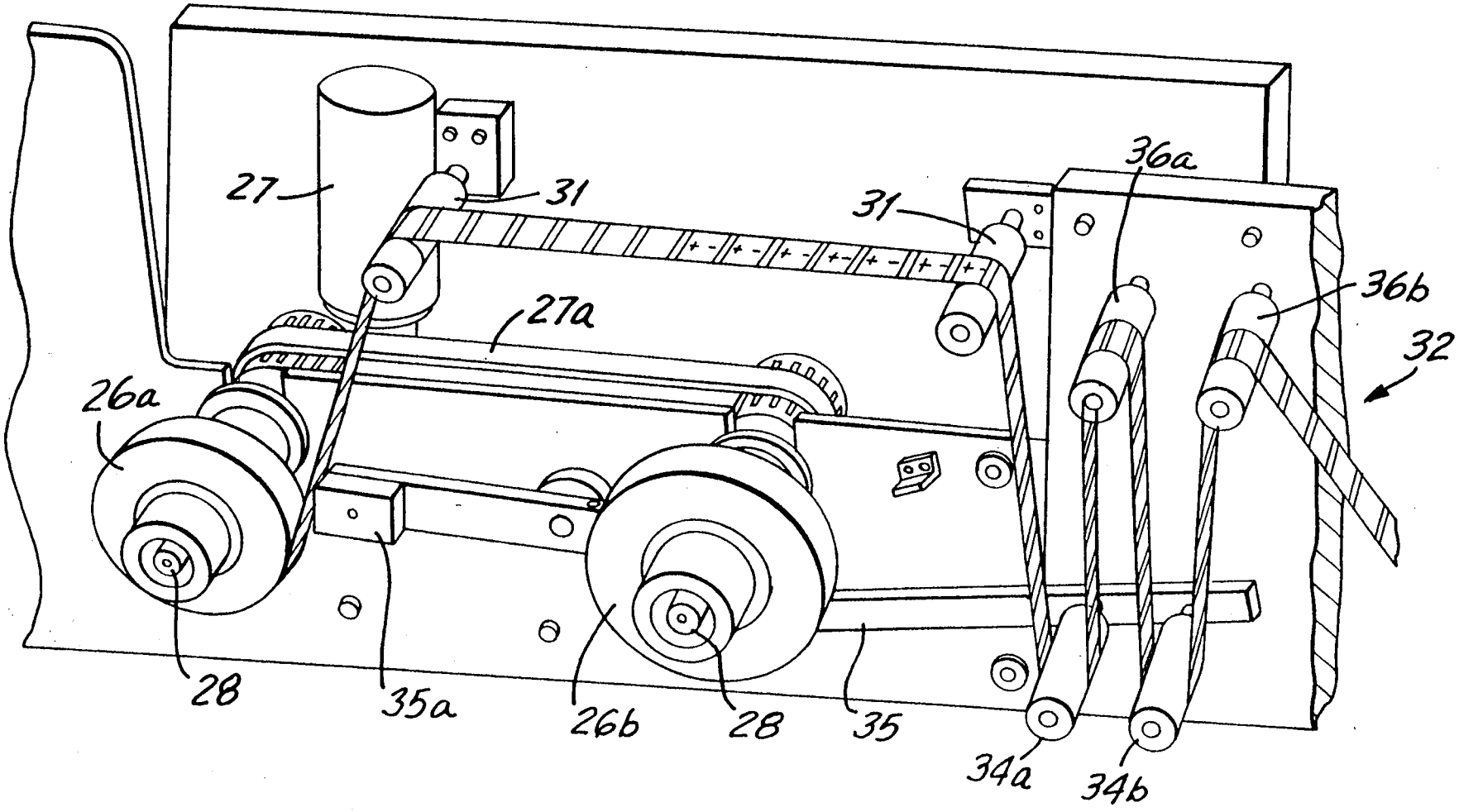
FIG. 3 is a pictorial view of one embodiment of the label unwinding mechanism and dancer roll assembly.
Figure 4:
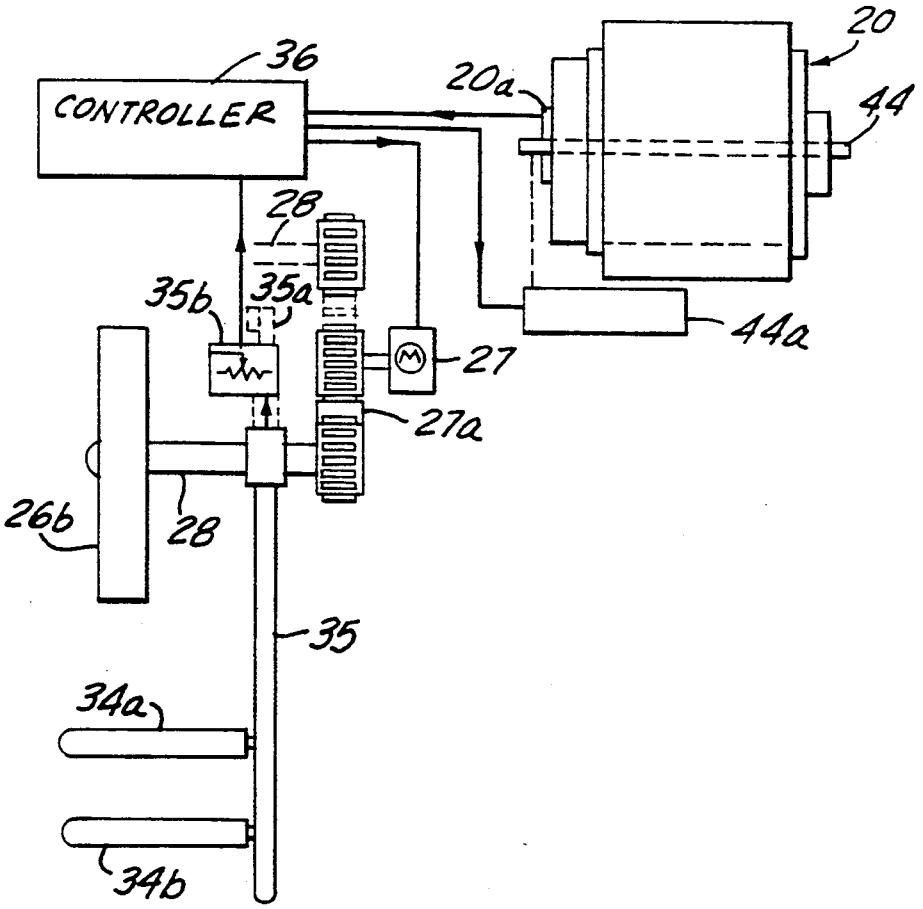
FIG. 4 is a schematic illustration of the interconnection among the label transport drum, film unwind assembly and dancer arm assembly.

Referring again to FIG. 1, in accordance with the present invention, the apparatus 10 includes a frame 23 for supporting major components such as the label transport drum, adhesive and solvent applicators, and rolls of continuous label material. The frame 23 includes leg supports 24 for supporting the frame on the floor. Two rolls 26*a*, 26*b* of label material are supported for rotation on the frame 23. The frame 23 supports an unwind drive motor 27 and dual roll support spindles 28 which support the rolls of label material. (FIGS. 3 and 4).

The unwind drive motor 27 is operatively connected to one of the spindles 28 by a transmission belt 27*a* which interconnects the two spindles for driving the spindles as the unwind motor 27 operates. The motor unwinds the film and provides tension to the film as the film is withdrawn to prevent slack buildup in the film during operation. When one supply roll is in use, the other provides a reserve roll which is used when the other roll is depleted.

The label material is pre-printed with identifying indicia (FIG. 32). Alternatively, a printing stamp or roller (not shown) may be positioned adjacent the label supply roll for printing directly onto the label material as it is withdrawn from the supply roll.

Figure 20:
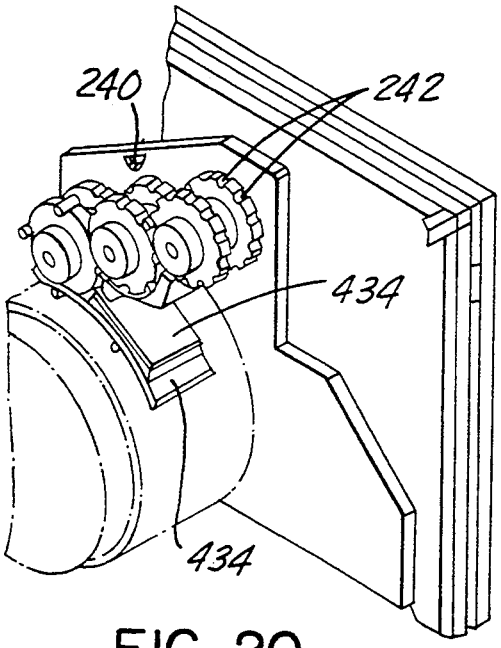
FIG. 20 is an isometric view of the star transfer wheel delivery assembly.

The present illustrated apparatus 10 can be designed for wrapping dry cells A that are fed in dual, parallel rows to each other or designed for feeding a single row of dry cells. In the illustrated embodiment of FIG. 32, each strip "S" of film label material has first and second continuous columns of printed indicia. During labeling, the strip "S" can be longitudinally slit by a conveniently positioned slitter knife 37, and then horizontally slit as will be explained later to form cut labels of predetermined size having leading and trailing edges 21*a*, 21*b* respectively (FIGS. 30A, 30B, and 31). In the description and other figures, the description will follow by describing a single feed of drycells A and label. A single or dual, parallel, side-by-side feed has no impact on the operation of the apparatus in accordance with the present invention. A dual side-by-side article feed does, however, provide a greater production capacity. An example of a dual feed of drycells is shown in FIG. 20 where the dry cells can be fed side-by-side in a double-row star transfer wheel assembly.

As indicated in FIGS. 1 and 3, label material is fed as a film strip "S" from the first supply roll 26*a* onto stationary idler rolls 31 and into a festooned dancer roll assembly indicated generally at 32, having a plurality of individual dancer rolls 34*a*, 34*b* (shown as two dancer rolls in FIGS. 3 and 4), which are rotatably secured to a dancer arm 35. The dancer arm 35 is pivotally mounted on the spindle 28 carrying the second roll 26*b*, and is free to pivot, i.e., swing up and down.

A counterweight 35*a* extends in the reverse direction from the dancer arm 35 and balances the dancer arm 35. The film strip "S" passes from the second idler roll 31 onto the first dancer roll 34*a*, up and around a first stationary idler roll 36*a*, down and around the second dancer roll 34*b* and up and around a second idler roll 36*b*. A potentiometer 35*b* is linked to the pivot of the dancer arm 35 (FIG. 4) and controls the speed of the unwind motor 27 by feedback signals to a controller 36 which is operatively connected to the unwind motor 27. As the dancer arm 35 is raised, the potentiometer 35*b* sends signals to the controller 36, which signals the unwind motor 27 to rotate at a faster rate of speed and feed out more film to the dancer roll assembly. The increase in feed rate causes the dancer arm 35 to drop into a lower position.

The potentiometer 35*b* signals the controller 36 of the dancer arm 37 drop, thereby causing the controller 36 to generate signals for slowing the unwind motor 27. In one embodiment, the controller 36 incorporates two processors working together, a G & L motion controller PIC 900 and a GE Fanuc PLC 90-30 controller CPU 331. Both controllers work together. The G&L motion controller operates the feed film and cutting operation as explained later, and the GE Fanuc controller operates basic label transport drum operation such as on-off operation and other assorted operations. In the alternative the G&L motion controller can control all operation.

The strip "S" passes over another idler roll 31 and through a registration sensor 37, which can be a fiber optic sensor. The registration sensor 37 detects light-dark areas corresponding to 1) printed and 2) non-printed areas (corresponding to the separation between respective printed labels). The signals indicate the transition from dark to light areas of film strip "S" indicating the real time location of leading and trailing edges of respective labels. The generated signals are communicated to the controller 36.

The strip 28 passes over idler rolls 38 (FIG. 1) and through a pair of feed rolls 39 rotating upward and outwardly from each other to and pulling the strip through the dancer roll assembly 32 (FIG. 1). The feed rolls 39 are rubber coated and powered by an A.C. servomotor 40 which is operatively connected to the controller 36. In one embodiment the servomotor 40 is a Giddings & Lewis Centurion Servo Drive known under the designation/N-401-34201-32.

The servomotor 40 drives the film at a rate that is proportional to the rate of speed of the label transport drum. This is accomplished through a position feedback incremental encoder 20*a* mounted on the label transport drum drive shaft 44 (FIG. 4). As the label transport drum rotates, the encoder feeds back positional information to the controller 36 which feeds film feed information to a servo motor amplifier integral with the servomotor.

FIG. 28 illustrates a block diagram of the various components such as the servomotor 40 and their relationship to the controller 36. Further details of the film feed and label transport drum encoder are explained below. Details of the label transport drum are next explained, however, to ensure that the overall context of the strip feeding and cutting is understood.

Before the strip passes through the servomotor driven feed rolls 39, a laser marker 38*a* marks the strip with an identifying code at the area defined by printed indicia corresponding to each label. Alternately, the laser marker 38*a* could be positioned and adapted for marking drycells and other articles after wrap around labeling. The strip then passes through a web tracking unit (shown by block 38*b*, FIG. 1), which senses the position of the strip edge using an ultrasonic eye. Based on the detected edge position, the web tracking unit maintains proper edge-to-edge tracking of the strip to ensure that it is later aligned properly during transfer onto the label transport drum.

The strip "S" passes over an idler roll 41*a* and into a cutting assembly where the film is cut into labels by means of a separate cutting drum and knife assembly, indicated at 42 (FIG. 5) which is explained in detail below. The cut labels are then transferred onto the label transport drum 20 at a label transfer position defined by the close proximity point between the label transport drum 20 and the cutting drum 42. In this description the labels are sized and cut for wrapping about AA size batteries, corresponding to labels that are about 49 mm×49 mm square, i.e., about two by two inches.

Figure 6:
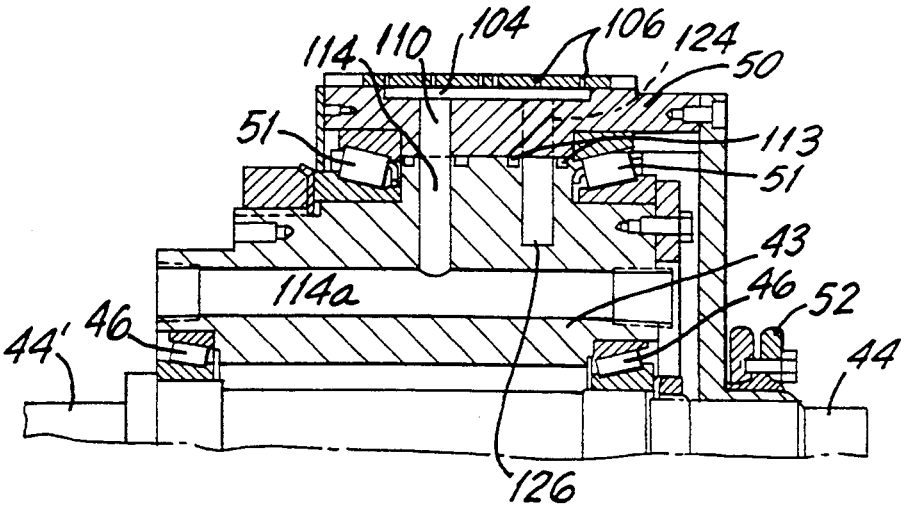
FIG. 6 is a half-sectional view of the label transport drum showing relative orientation of the label drum, hub and first and second manifolds.
Figure 7:
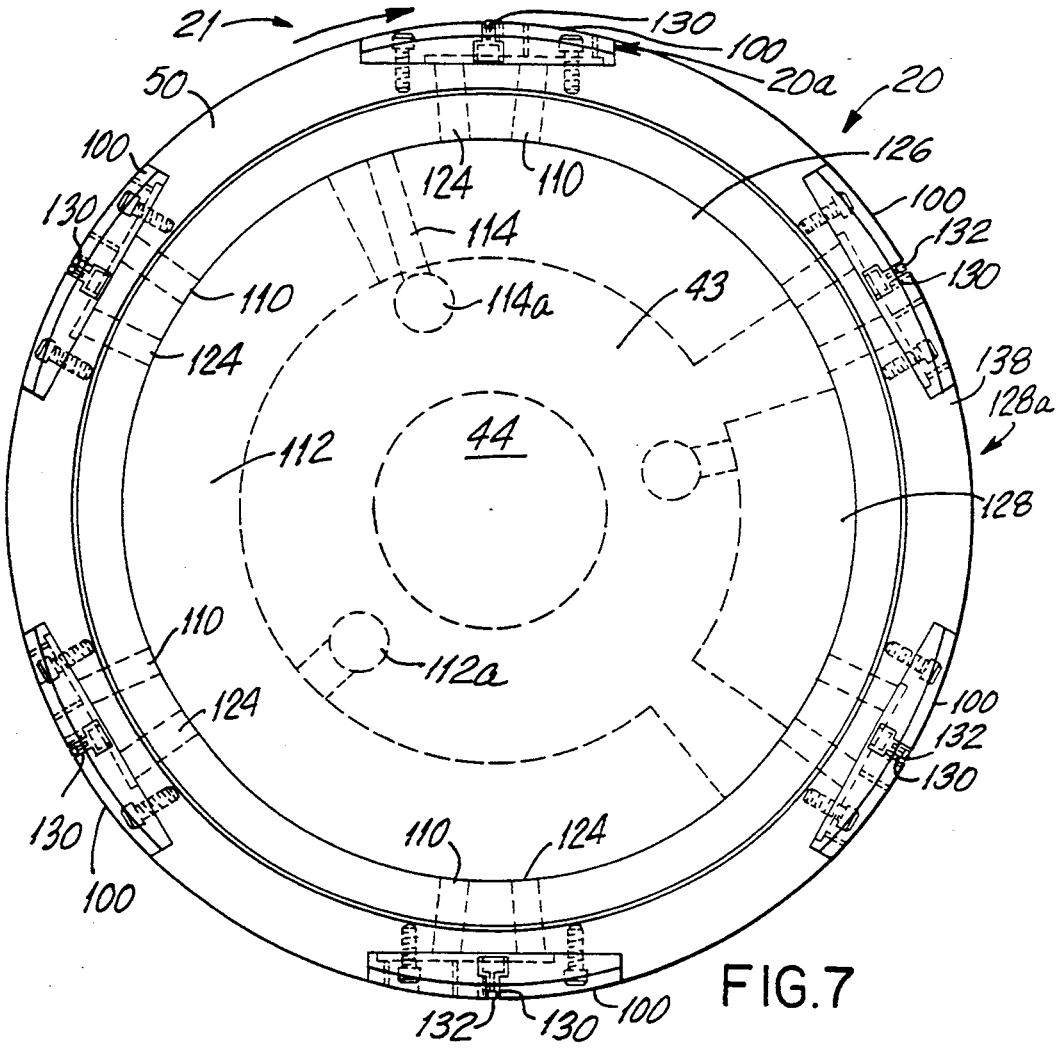
FIG. 7 is a side sectional view of the label transport drum having six label retaining insert plates positioned along the outer surface of the drum.

For purposes of understanding, the construction of the label transport drum 20 is described first followed by greater details of the cutting drum and knife assembly 42. In accordance with one embodiment, the label transport drum 20 includes an internal, cylindrically configured hub 43 secured directly to the machine frame 23 (FIGS. 6 and 7). A drive shaft 44 (FIGS. 2, 6 and 7) passes through the hub and is rotatably mounted by bearings 46 positioned in the hub. A cylindrically configured label drum 50 is mounted for rotation on bearings 51 about the hub (FIG. 6). The drive shaft 44 operatively connects to the label drum 50 by a suitable coupling assembly 52 so that as the shaft is rotated, the label drum 50 rotates about the hub. The label transport drum encoder 20*a* is mounted on the drive shaft 44 (shown schematically in FIG. 4). Drive means 44*a* is operatively connected to the drive shaft 44 by suitable transmission means, and rotates the label drum 50 about the hub. In one embodiment, the label transport drum drive means 44*a* is a brushless D.C. motor, and uses a gear transmission for imparting rotative force to the label transport drum.

Figure 9:
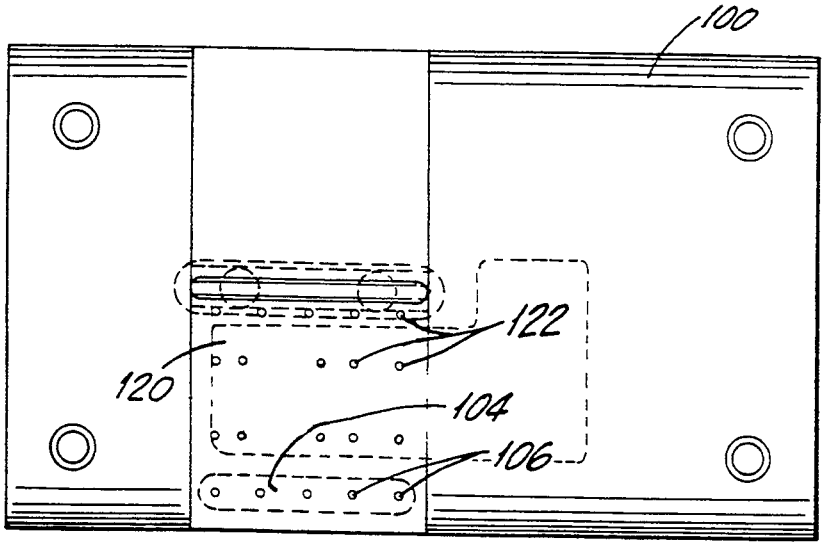
FIG. 9 is a plan view of a label retaining insert plate.

As shown in FIG. 7, the label transport drum 20 of one embodiment includes six evenly spaced label retaining insert plates 100 for receiving thereon the labels at predetermined label areas 100*a* where labels are retained to the drum surface for wrap around labeling (FIG. 9). The label transport drum typically is formed from steel construction and has cut-outs dimensioned to receive the label retaining insert plates 100. The label retaining insert plates 100 are formed from steel or other rigid, high strength material that can resist the high speed impact of batteries and other small articles as they are fed onto the drum and insert plates as well as the high rotative speeds and vibration associated with heavy mechanical machinery.

Figure 2:
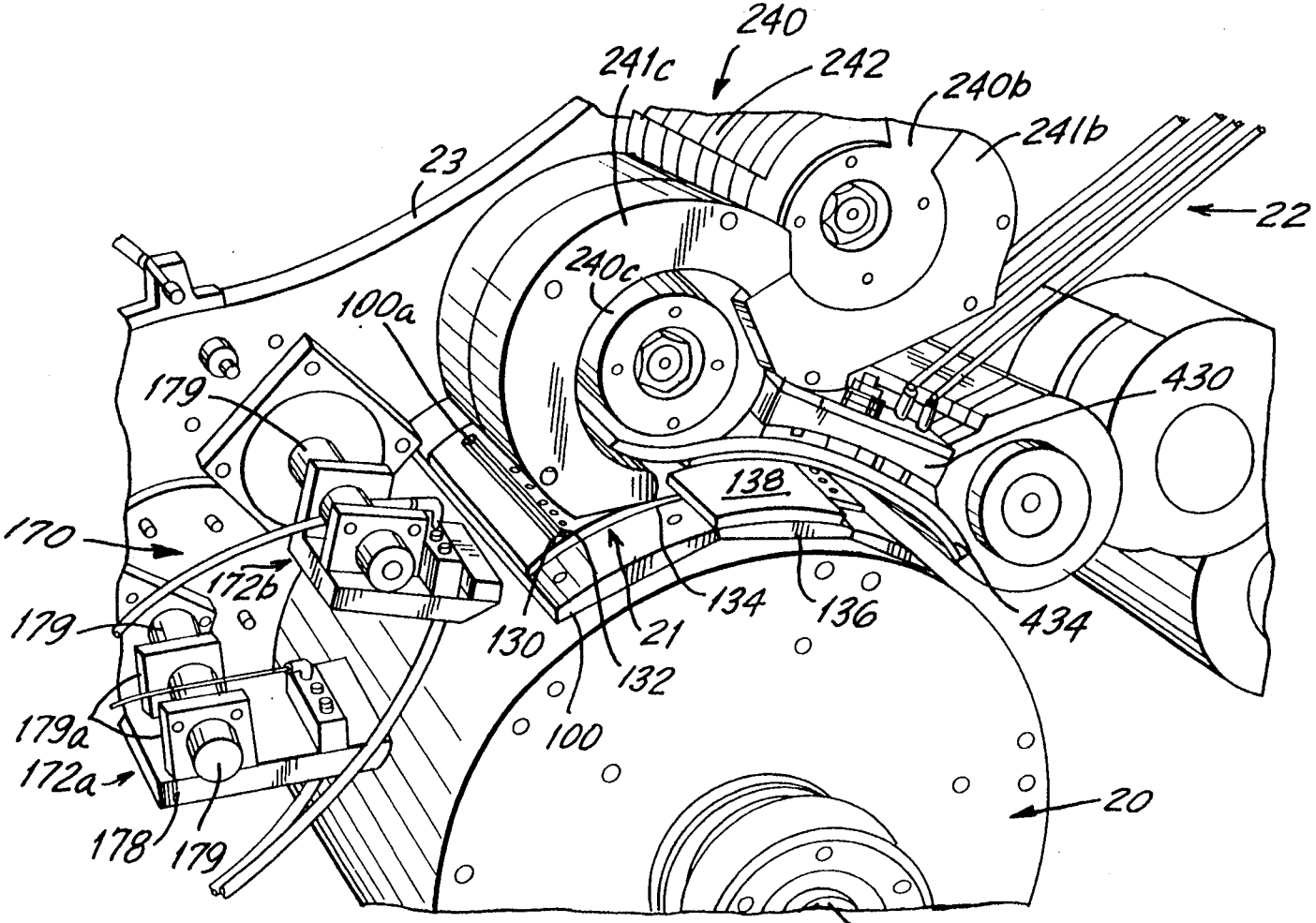
FIG. 2 is a pictorial view of one embodiment of the label transport drum.
Figure 8:
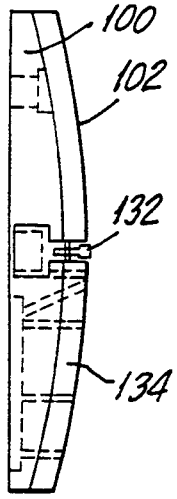
FIG. 8 is a side elevation view of a label retaining insert plate.

Each label retaining insert plate 100 is substantially rectangular configured and has a top surface 102 that is configured substantially similar to the curvature of the drum surface (FIGS. 2 and 8). The undersurface of each insert plate 100 includes two plenums formed in the surface. A first plenum 104 is formed on the undersurface and has orifice holes 106 (FIG. 9) extending upward to communicate with the surface of the label retaining insert plate 100 at the area where the leading edge of the label is positioned.

Figure 7A:
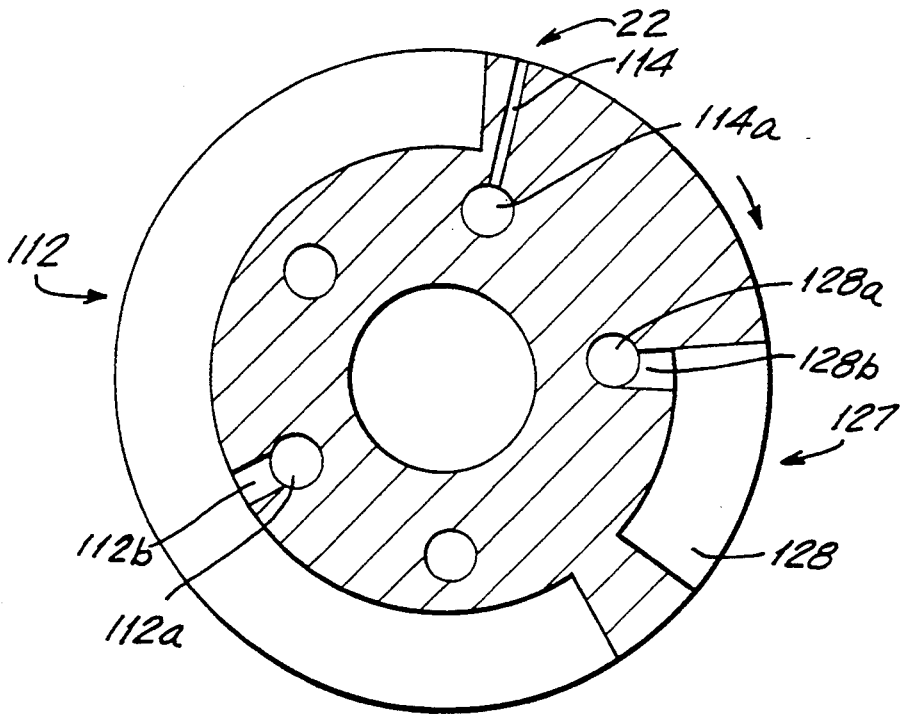
FIG. 7A is a sectional view of the hub showing the configuration of the first vacuum manifold and pressure manifold.

The first plenum 104 includes a port 110 (FIG. 10) which is positioned in circumferential alignment with a circumferentially extending, slotted vacuum manifold 112 formed in the hub opposing the inside surface of the label drum 50 (FIGS. 6, 7 and 7A). Vacuum is drawn through a central horizontally extending vacuum supply manifold 112*a* which communicates with the vacuum manifold 112 via a gate manifold 112*b*.

The vacuum drawn in the vacuum manifold retains the leading edge of the label on the surface of the drum as the drum initially rotates after a cut label has been applied thereto. The port 110 is aligned over the vacuum manifold so vacuum is drawn through the port 110 and plenum 104 until the label reaches the article wrapping position 21 (FIG. 7). At that point, the port 110 is positioned over a pressure manifold 114 at the article wrapping position 21, which exerts air pressure supplied from a horizontal air pressure manifold 114*a* against the leading edge of the label to help push the label against an article. FIG. 6 shows the port 110 aligned over the pressure manifold 114. The manifold 114 is narrow and provides a burst of air against the leading edge of the label to push the leading edge upward against the dry cell which has been fed onto the drum. Seals 113 between the drum and hub prevent air and vacuum leakage.

A second plenum 120 is formed in the undersurface of each label retaining insert plate 100 and has orifices 122 extending therethrough to communicate with the surface of the insert plate 100 at an area where the trailing edge and midportion of the label are positioned. This second plenum includes a port 124 which is aligned circumferentially with a second circumferentially extending, slotted vacuum manifold 126 (FIGS. 6, 7, and 7B) formed in the hub to retain the trailing and midportion of the label thereto.

Figure 7B:
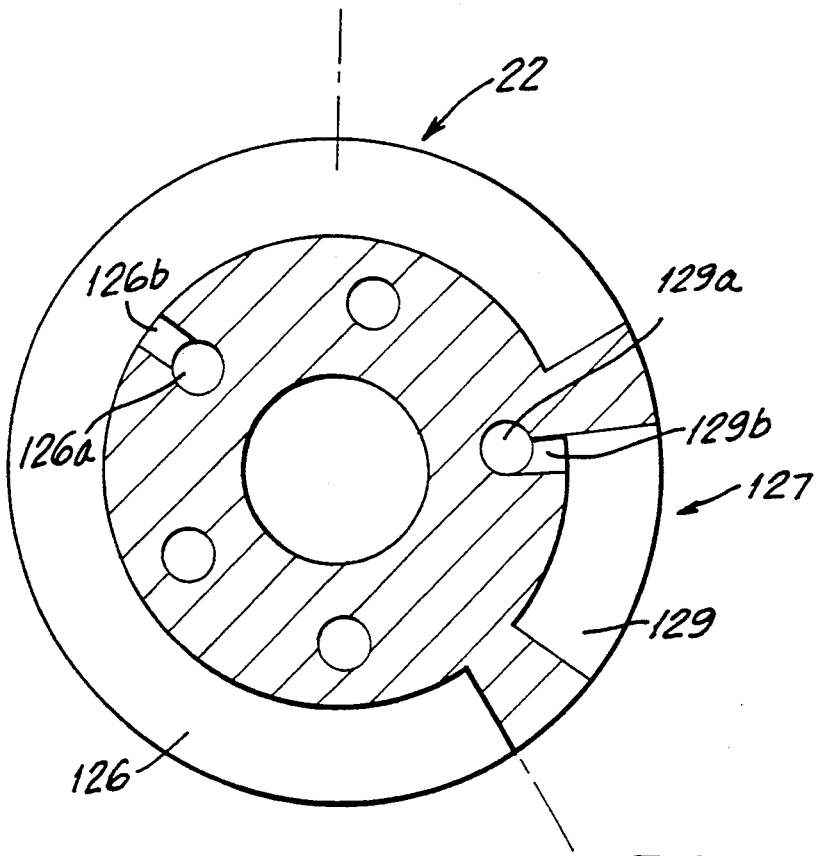
FIG. 7B is a sectional view of the hub showing the configuration of the second vacuum manifold.

The second vacuum manifold 126 starts from a position offset but parallel to the first vacuum manifold 112 and extends past the first vacuum manifold and pressure manifold 114 defining the article wrapping position 21 (FIG. 7). The second vacuum manifold begins adjacent to where the first vacuum manifold 112 begins, but the second manifold extends past the article wrapping position approximately 40° (FIG. 7B). A horizontally extending manifold 126*a* communicates via a gate manifold 126*b* with the second vacuum manifold 126.

The second vacuum manifold 126 retains the label onto the drum if the leading edge does not engage an article to be transferred thereto and moves the label to a blow-off position 127 where the label is blown therefrom off from the drum. If the leading edge does engage an article and is transferred, vacuum draw between the label and drum surface is broken intermittently as the label is rolled upward on the article, similar to opening a "sardine can". First and second blow-off manifolds 128, 129 (FIGS. 7A, 7B) provide pressure for blowing off labels at the label blow-off position 127 when labels have not been transferred, but retained onto the drum surface, such as occurs when an article misfeeds (FIGS. 7, 7A, and 7B).

The first blow-off manifold 128 is circumferentially aligned with the first vacuum manifold 112 and the pressure manifold 114. A horizontally extending air supply manifold 128*a* communicates via a gate manifold 128*b* with the manifold 128. The second blow-off manifold 129 is circumferentially aligned with the second vacuum manifold 126. A second horizontally extending air supply manifold 129*a* communicates via a gate manifold 129*b* with the second blow-off manifold 129. Thus, both blow-off manifolds 128, 129 provide the pressurized air necessary for blowing off the labels retained on the drum surface past the article wrapping position 22.

A slot 130 is formed in the upper surface of the insert plate 100 and extends transversely across the plate in a position where the area adjacent the trailing edge of a label is positioned on the plate. (FIGS. 2, and 6 through 9). A longitudinally extending, spring biased plunger, indicated generally at 132, is positioned in the slot 130 and biased upward, so that the plunger engages and biases upward the label area adjacent its trailing edge. During wrap around labeling, the plunger is depressed by the dry cell so that the plunger does not interfere with the wrapping process. The drycell pushes against the plunger, depressing it, in essence creating a substantially smooth surface for labeling, necessary for proper wrap around labeling of small cylindrical articles.

Figure 5A:
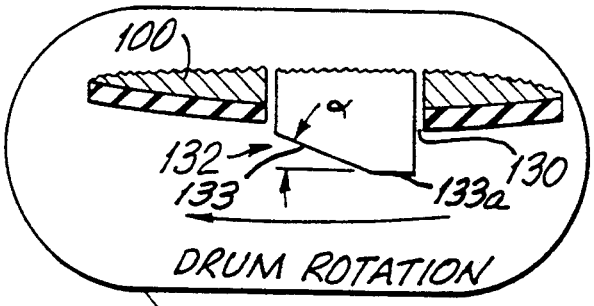
FIG. 5A is an enlarged view of the spring biased plunger used for positioning the trailing edge of the label outward from the periphery of the drum.

As shown in greater detail in FIG. 5A, the plunger 132 has an end portion with an upwardly inclined surface 133 in the opposite direction of drum rotation and a substantially flat, land portion 133*a* following the upwardly inclined surface 133. The plunger can be formed by plastic or other similar material. The upwardly inclined portion 133 can be formed such as by grinding, thus forming with the land portion 133*a* a crown-type configuration in the direction of drum rotation.

The angle ($\alpha$) of inclination of surface 33 is typically about 15° to 40° but can vary widely. It has been found that about a 30° inclination is beneficial for labeling "AA" size drycells with thin film polymer labels, though naturally, that range can vary depending on the type of article to be labeled, the film thickness, the film material, and other factors. In one embodiment, the plunger is about 0.010 to 0.25 inches wide, with a land area of about 0.01 to about 0.08 inches wide, and more preferably the plunger is about 0.125 inches wide with a 0.03 inch wide land area. This novel plunger configuration with a narrow land area provides for a more narrow solvent wipe onto the trailing edge of the label, yet has a wide enough land 133*a* dimension to provide a good solvent seal wipe. It has been found that the more narrow land 133*a* wipe reduces mottling of solvent on the label. The plunger in one embodiment extends about 0.040 inches from the drum surface.

It has been found that the orientation of the plunger may be reversed so that the surface inclination is opposite that illustrated in FIG. 5A and still provide a desired solvent wipe in accordance with the present invention. The present configuration where the inclined surface 133 is in the direction opposite to drum rotation provides a gentle inclination on which the drycell rolls over during labeling.

Each insert plate 100 also has a resilient surface formed from a material such as a rubber insert 134 placed over a substantial portion of the outer surface of the plate (FIGS. 2 and 8). The orifices and slot 130 are formed also within the rubber insert 134. The rubber insert 134 forms a soft cushion on which the drycell rolls during wrapping.

Because the rubber acts as a cushion, the article is deflected slightly into the cushion material during wrapping by means of the pressure applicator 22 (FIG. 1) so as to create a "footprint" in the soft, cushion material. The pressure applicator 21 imparts a desired pressure onto selected areas of the sides and ends of the article during wrapping to ensure end-to-end label alignment of the wrapped labels and prevent mismatching of the label during wrapping. During wrapping, the air is squeezed out between the article, label, and drum surface, allowing better wrapping of the label about the article. During wrapping, the plunger 132 is biased inward by the article so that the plunger does not interfere with the article, label and drum surface during labeling.

As best shown in FIG. 9, the portion of the label retaining insert plate adjacent the plunger 132 and opposite the area where the midportion of a label rests is void of orifices. As a result, no vacuum is drawn at the very trailing edge of the label, and the solvent will probably not be drawn down into the slot 130 and around the sides of the label. If solvent were drawn around the label, the solvent would dissolve more of the label, creating a poor looking seam.

The drum also includes six label surface plates 136 (FIGS. 2 and 7) positioned respectively between label retaining insert plates 100. Each surface plate 136 includes a resilient surface insert 138 such as formed from rubber or other similar material. The rubber insert surfaces 134 and 138 form a continuously resilient, rubber surface on the label transport drum which also increases the friction between the article, label and drum surface. As a result, less pressure must be exerted by the pressure applicator 22 during article wrapping. The reduced pressure creates a clearer seam during article wrapping without having excess solvent squeezed out of the seam causing uneven mottling in areas adjacent the seam. This aspect of the invention is important with wrap around labeling of small, cylindrical articles. The schematic isometric of FIG. 2 only shows in detail one label retaining insert plate 100 and surface plate 136. It is understood that the plates extend along the entire periphery as shown in the more detailed side sectional views.

Figure 5:
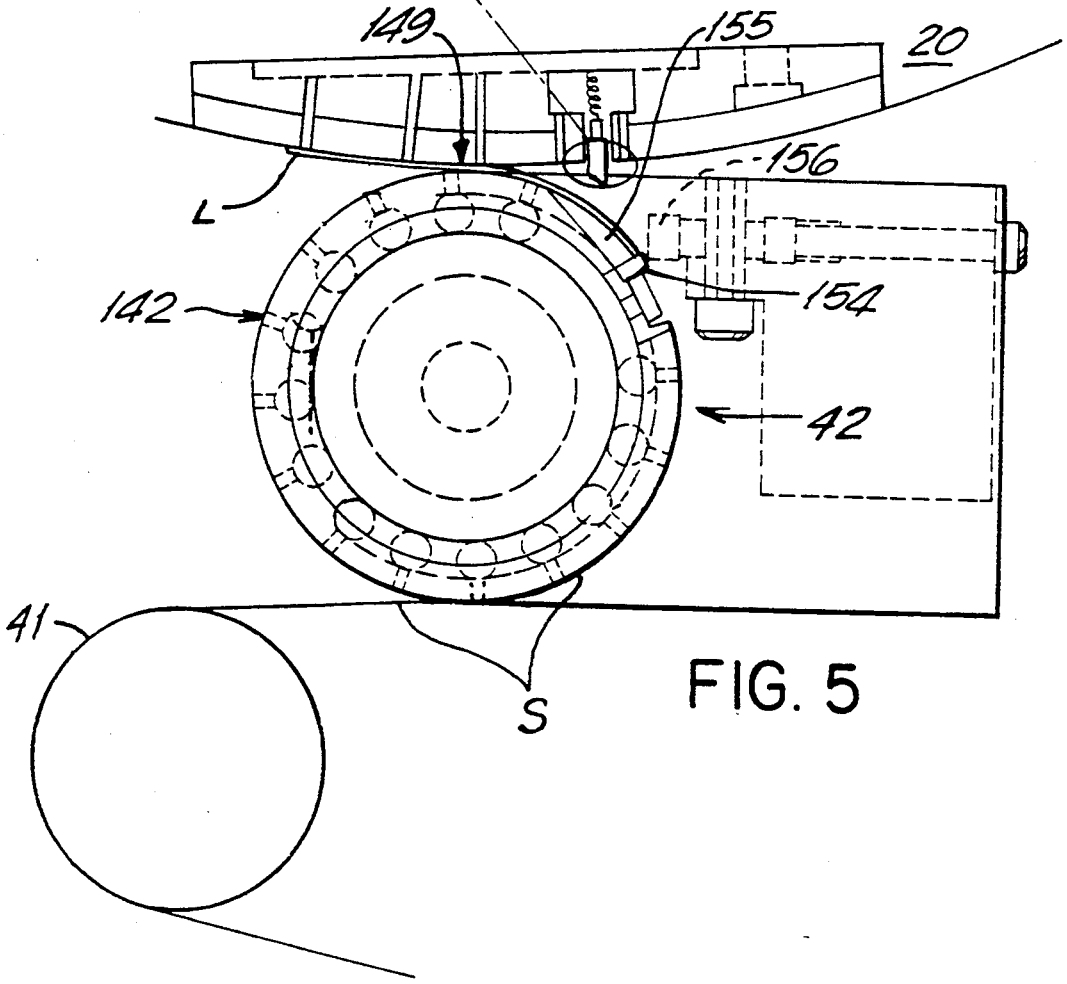
FIG. 5 is a schematic side elevation view of the cutting drum for cutting the film into labels and transferring the cut labels onto the label transport drum.
Figure 5B:
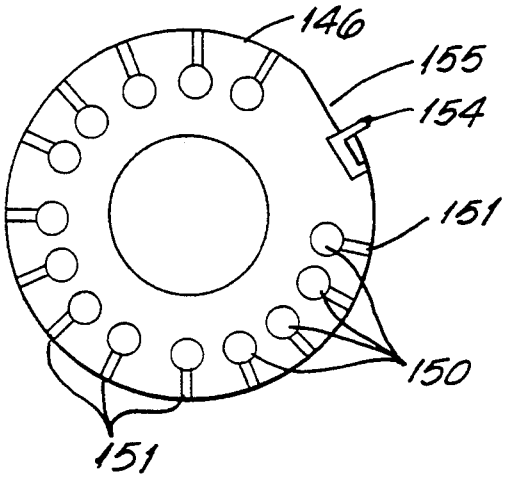
FIG. 5B is a schematic side elevation view of the rotatable cutting drum showing in greater detail the axially extending air ports.
Figure 5C:
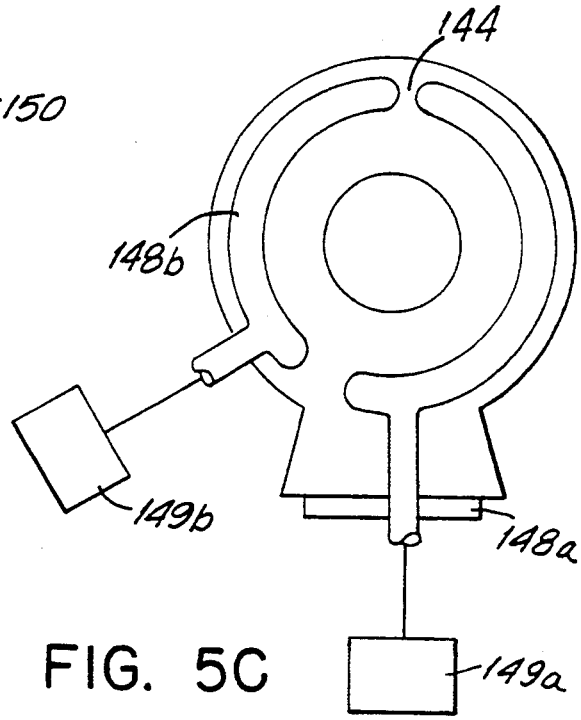
FIG. 5C is a schematic end view of the cutting drum end hub.
Figure 5D:
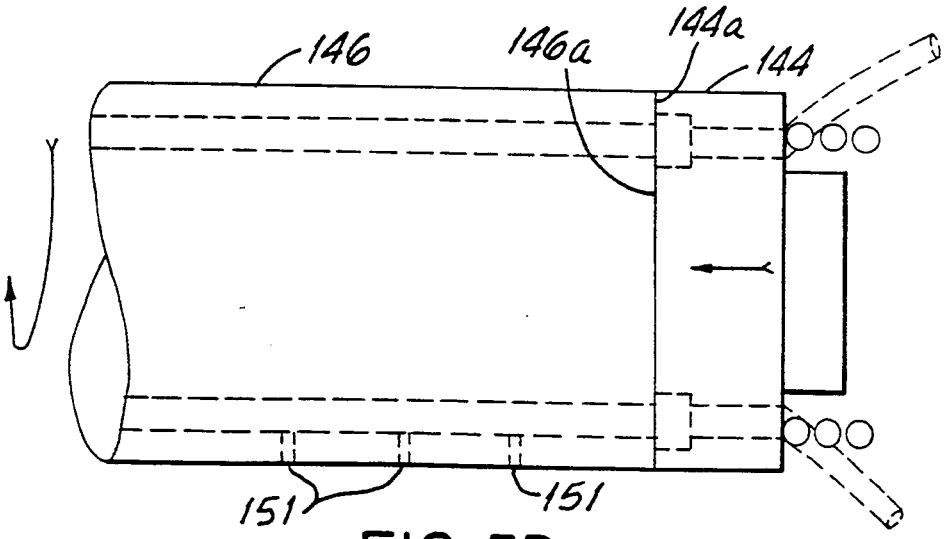
FIG. 5D is a side elevation view of the cutting drum and end hub.

Referring now to FIGS. 5 through 5D, details of the off-drum cutting assembly 142 are illustrated. The cutting drum 142 could be formed similar to the label transport drum in that the cutting drum 142 has an inner hub and a cutting drum mounted thereon. The hub could include vacuum and pressure manifolds which define a film retention area and a label transfer position where the pressure from the pressure manifold blows the label outward toward the label transport drum 20.

FIGS. 5 through 5D show the basic components of another embodiment of the cutting assembly 142. The cutting assembly 142 includes a stationary end hub 144 and a cutting drum 146 rotatably mounted to the end hub 144 by a shaft 147 that extends through a bearing mount of the end hub 144, and which is secured to and supports the cutting drum 146. The shaft 147 is preferably driven directly from the drive of the label transport drum such as by a direct gear coupling shown schematically at 147*a* in FIG. 1. The shaft 147 can be frame mounted.

As shown in FIG. 5D, the face 144*a* of the end hub 144 is biased by springs 144*a* against the face 146*a* of the cutting drum 146. The faces 144*a*, 146*a* form a tight vacuum and pressure seal. The end hub face 144*a* includes two manifolds 148*a*, 148*b* formed therein on opposing, circumferential sides. The first manifold 148*a* is operatively connected to a source of vacuum 149*a*, forming a vacuum manifold 148*a*. The second manifold 148*b* is operatively connected to a source of pressure 149*b*, forming a pressure manifold. The cutting drum 146 includes a plurality of axially extending port openings 150 that extend into the cutting drum (FIG. 5B). The port openings 150 align with the manifolds 148*a*, 148*b*. The surface of the cutting drum includes orifices 151 that extend into cutting drum 146 and communicate with respective port openings 150.

As shown in FIG. 5C, the vacuum manifold 148*a* extends approximately 180° around the end face 144*a*. When the end hub 144 is biased against the cutting drum 146, the port openings 150 engage the vacuum and pressure manifolds 148*a*, 148*b* and resulting vacuum and pressure formed in the port openings The vacuum manifold 148*a* is designed such that vacuum is drawn on the surface of the cutting drum 146 when the label strip is first fed onto the cutting drum and continues until the strip has moved with the rotating drum to an area adjacent the closest point to the label transport drum 20, corresponding to label transfer position. The pressure manifold 148*b* begins at a point adjacent the label transfer position and arcuately extends past the label transfer position so that air will be exerted against a label toward the label transport drum when the label moves into the label transfer position. If the label does not transfer properly onto the label transport drum 20, it is forced from the cutting drum as the cutting drum rotates further.

The cutting drum 146 has a circumference that is equal to one pitch of the label transport drum 20, i.e., in the illustrated embodiment nine inches corresponding to the six pitches of the fifty four inch label transport drum 20. The cutting drum 146 is gear driven at a six-to-one ratio directly from the label transport drum 20. As the label transport drum 20 completes one revolution, the cutting drum 146 completes its sixth revolution.

As the label strip is advanced by the servomotor driven film feed rollers 39, the strip advances over the idler roll so as to bring the film strip "S" into tangential contact with the cutting drum surface. At the contact point between the cutting drum 146 and the label strip, the internal vacuum retains the strip to the drum surface. The outer periphery of the cutting drum surface is advanced one revolution, i.e., about nine inches. The strip, however, is advanced only one label length (about two inches for an "AA" size battery) by the servomotor feed rollers 39. This speed differential causes the metered strip to slip on the surface of the rotating cutting drum 146.

The cutting drum 146 includes a cutter blade 154 which protrudes outward from the drum surface. A stationary cutter blade 156 is fixed onto the frame 23 and spaced outward a small distance from the cutting drum periphery. As the cutting drum 142 rotates, the cutter blade 154 engages the stationary cutter blade 156 to cut the strip into a label. The intersection where the cutter blade 154 engages the stationary cutter blade 156 defines a cut point 157 for the cutting drum because at that point, the strip is cut.

The cut point is positioned less than the length of one label, i.e., in the present description using "AA" size batteries, less than two inches along an arcuate distance from the label transfer position so that the leading edge of the label is beginning its transfer onto the label transport drum just before cutting. The vacuum draw in the label transport drum helps secure the leading edge of label onto the vacuum drum surface once the leading edge is blown outward against the label transport drum.

As shown in FIGS. 5 and 5B, the cutting drum includes a relief area 155 positioned just before and adjacent the cutting blade 154. This relief area 155 receives the trailing edge of the label after cutting and provides clearance for the plunger 132 that extends outward form the drum surface.

The cutting drum is positioned close to the label transport drum to ensure proper label transfer, typically about 0.015 to about 0.025 inches when working with labels for wrapping "AA" size dry cells. The plunger, however, extends as much as 0.040 inches from the drum surface, a distance necessary to position the trailing label ledge far enough from the peripheral drum surface, to engage a static wiper. The plunger should not engage the cutting drum periphery during label transfer because the label may be displaced during transfer if the cutting drum 146 were to press against the plunger. Accordingly, the plunger 132 moves into the relief portion 155 when the relief portion moves toward the label transfer position. At that point, the label is gently transferred onto the label transport drum and onto the outwardly biased plunger without label misplacement by the air pressure exerted in the pressure manifold 148*b*.

Because the gear drive ratio and diameter/circumference relationship between the label transport drum 20 and cutting drum 146 are constant, both rotate at the same surface speed, and label transfer from the cutting drum occurs at a precise position on the label transport drum surface where the label retaining insert plates 100 are positioned.

The encoder 20*a* on the shaft of the label transport drum 20 generates signals to the controller 36 indicative of the position of the label areas and velocity of the label transport drum. The registration sensor is spaced a known, predetermined distance from the cut point, and transmits signals to the controller indicative of the presence or absence of light areas, dark areas and transition zones between light and dark areas indicating the trailing and leading edge. The servomotor feed system 39, 40 is the corresponding "slave" in the system and the controller 39 signals the servomotor feed system to make corresponding adjustments in film feed based on the signals detected from the registration sensor and encoder 20*a*.

The registration sensor inputs data to the controller 36 indicating the time when indicia corresponding to the trailing edge of the label has passed the fiber optic sensor 37*a*. The encoder 20*a* signals the positional and velocity information regarding the cycle of the label transport drum 20 and cutting drum 146. The controller 36 then makes corresponding adjustments to the servomotor 40 to cause the film feed to slow or quicken, thus ensuring that the trailing edge of a label is positioned at the cut point 157 when cutting occurs. If a large error has occurred, such that cutting occurs in the middle of a label (i.e., the film is fed so that the middle of the label passes the cut point when the blade elements join), the registration sensor will detect only areas corresponding to the middle portion (dark) of the label, and the controller 36 will automatically make adjustments. If the problem still persists, the controller 36 shuts down labelling and film feed. The machine faults to an "E" stop.

FIG. 28 illustrates a block diagram showing the interrelation among the controller 36 and the components that generate signals to the controller and receive control signals therefrom, i.e., the dancer arm potentiometer 35*b*, the film feed servomotor 40, and the film registration sensor 37, the label transport drum encoder 20*a*, and the film supply unwind motor 27. FIG. 29 illustrates a basic flow chart for the film feed mechanism to ensure strict strip feed, label cutting and transfer onto the label area of the label transport drum.

The system is initially purged by rotating the label transport drum and cutting drum and blowing any scrap labels from the cutting drum and label transport drum (Block 158). The film is then advanced (Block 158*a*). During this initial film feed, the feed rate is synchronized with the detected position and velocity of the label transport drum 20 and the sensed film indicia (Block 158*b*). As a result, the film feed is advanced or retarded for the first four or five cut labels until the film feed is synchronized (Block 158*c*) so that the trailing edge aligns at the cut point during cutting.

These first cut labels, if transferred, are scrap and can be ejected from the label transport drum at the label blow-off area. The film feed is stopped. Then the entire apparatus is placed into a jog mode to initially begin wrap around labeling. The film is then fed normally, the leading edge transferred, while cutting occurs at the trailing edge of the label. If film tension or slight differences in label dimension cause cutting to occur slightly off the trailing edge, the registration sensor, being positioned a predetermined distance from the cut point, detects the trailing edge, inputs that data to the controller, and based on the known distance and the feed rate of the servomotor driven feed rolls, makes corresponding adjustments to the feed rate so that the trailing edge of a label is precisely aligned with the cut point (Block 158*d*). Additionally, if one parameter of the system changes, such as by knocking the registration sensor from its set position, the operator can visually inspect film feed on the cutting drum and adjust the film feed so that the trailing edge aligns with the cut point at cutting.

As the vacuum secured label moves with the rotating label transport drum 42, the leading edge of the label advances to an adhesive applying position where adhesive is supplied from an adhesive application system. For purposes of understanding and clarity, components of the adhesive application system have reference numerals beginning in the 300 series.

Figure 11:
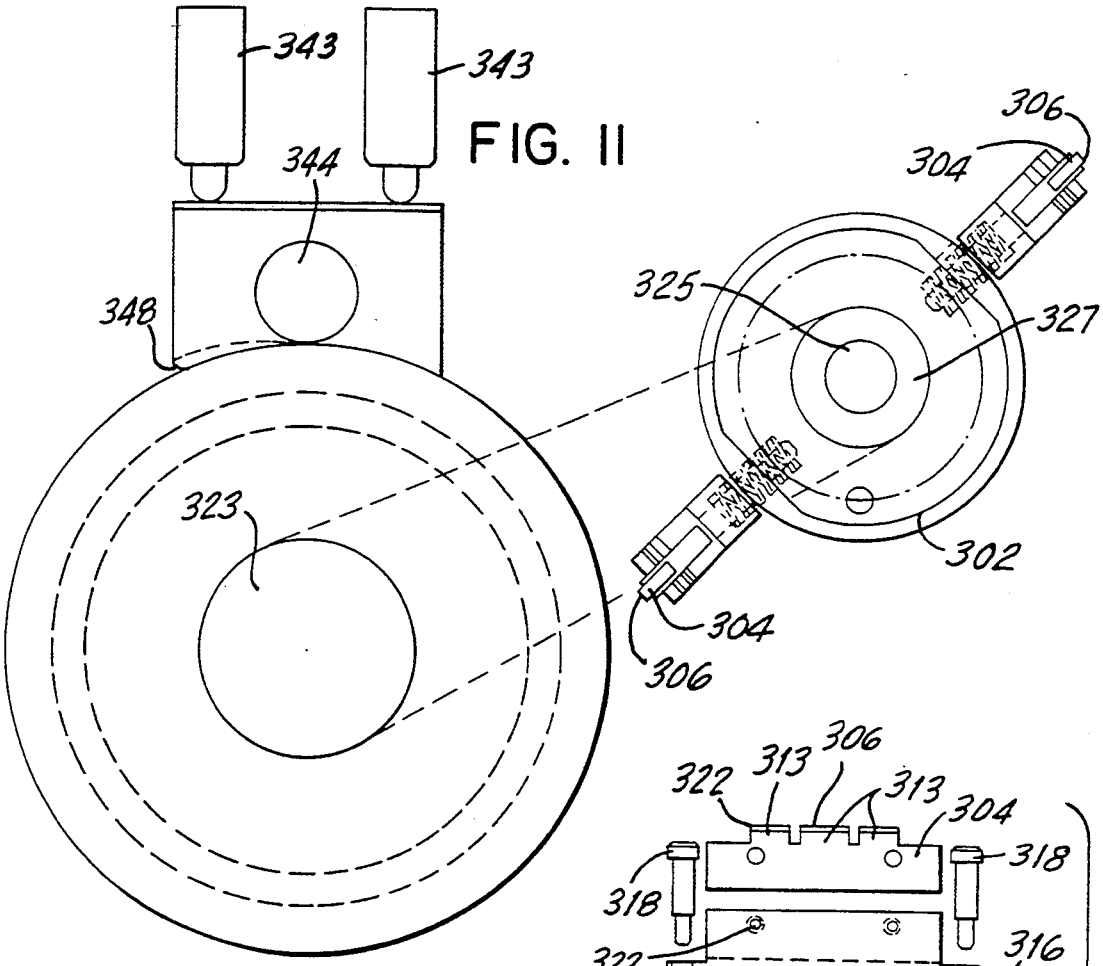
FIG. 11 is a schematic view of the gravure roller, rotary pad print head and adhesive distribution block.
Figure 12:
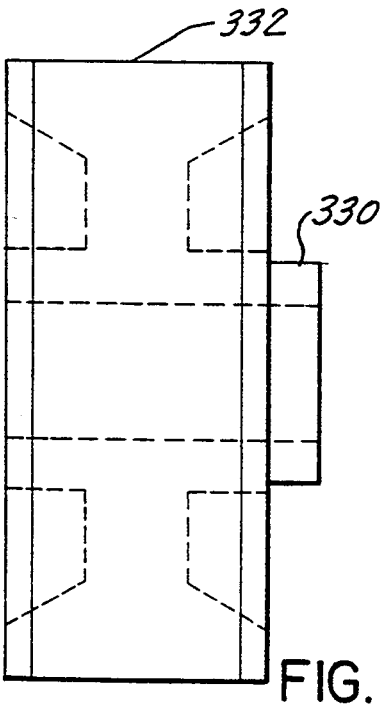
FIG. 12 is an elevation view of the gravure roller.

As shown in FIG. 11, the adhesive application system 300 includes a rotary pad print head 302, which is timed to rotate at the substantially same surface speed with the label transport drum. The rotary pad print head 302 includes outwardly extending adhesive print pads 304. The print pads 304 typically are rectangular configured, and include a pad face 306 which engages the label so that the adhesive is printed onto the leading edge of the label. The print pads 304 engage a rotating gravure roller 308 which transfers the adhesive to the print pads 304. The depth of indentations in the gravure roller 308 determine the amount of transferred adhesive. The print head 302 is timed to rotate with the label transport drum such that the print pad 304 engages the leading edge of the label at the same surface speed of the drum so that the adhesive is "printed" against the leading edge of the label.

Figure 13:
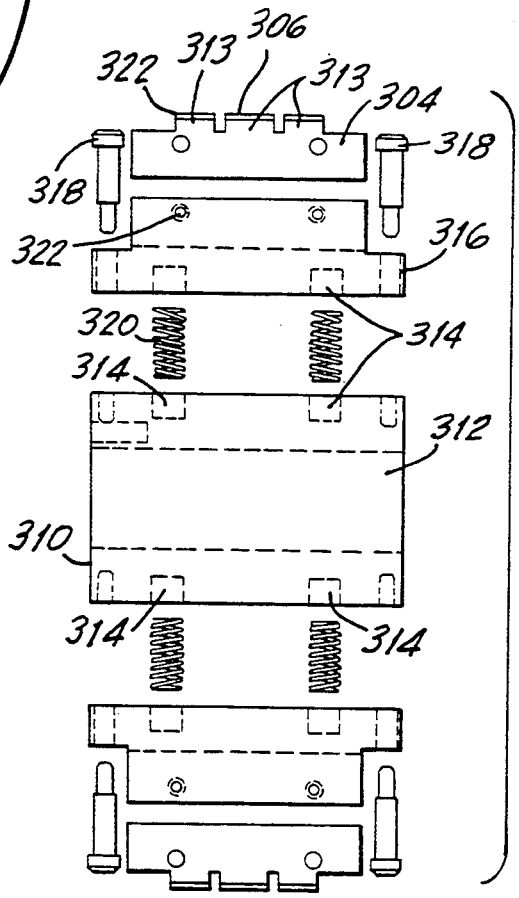
FIG. 13 is an exploded plan view of a portion of the rotary pad print head.

The rotary pad print head 302 is formed from a central, cylindrically configured hub 310 which has a central orifice 312 for rotatably mounting the hub 310 on a support shaft (not shown) secured to the frame 23. The hub 302 includes two sets of spring receiving bores 314 (FIG. 13) and a spring retainer 316 secured by bolts 318 in overlying engagement to the bores 314 on the outer periphery of the hub for retaining springs 320 within the bores 314. The bolts 318 provide longitudinal clearance with the spring retainer 316 so as to allow the retainer to move outward from the hub 310 under spring pressure. The print pads 304 are secured to the spring retainers by bolts, adhesive or other retaining means that one skilled in the art chooses. In the illustrated embodiment of FIG. 13, bolts (not shown) are inserted through holes 322 received in the spring retaining member 316 and print pad 304.

In a preferred aspect of the invention, the print pad 304 includes three outwardly extending label engaging pad areas 313 (FIG. 13), forming a label engaging pad face about two inches long, i.e., about the width of a label used for labeling "AA" dry cells. The print pad typically is about 0.050 to about 0.200 inches long, and typically is about 0.100 inches wide, and forms flat face 306 for printing the adhesive. The print pads 304 can be formed from a strip of resilient rubber, silicone or other material.

The gravure roller 308 is frame mounted on a shaft 323 and includes a central load bearing hub 330, and an outer wheel face 332 having indentations for retaining the adhesive applied thereto. The shaft 323 can be directly driven from the label transport drum 20. The gravure roller 308 is preferably constructed so that its etched surface will retain about a 0.0007 inch layer of glue thereon. This thickness has been found appropriate for use with a print pad as described and for printing adhesive on the described labels for "AA" or similar sized cells.

Both the gravure roller 308 and the rotary pad print head 302 can be driven together from the label transport drum by suitable transmission means 336 such as gears, chain or belt interconnecting the support shafts (FIG. 1). In one aspect of the present invention, the rotary pad print head 302 is mounted on a shaft 325 and rotates at a three-to-one ratio to the label transport drum. The print head 302 preferably includes a clutch 327 mounted on the shaft 325 for engaging and disengaging the print head from its shaft drive system. The clutch engages and disengages, moving the print head out of rotative engagement with the gravure roller and label transport drum.

As noted in the foregoing copending '573 patent application, a cold adhesive is more desirable than a hot melt adhesive because a hot melt adhesive tends to distort the thin film label material, forming an adhesive joint of poor appearance and low seam quality such as would occur if the method and apparatus were used as disclosed in U.S. Pat. No. 4,844,760 to Dickey.

As used herein, the term cold adhesive is defined as those adhesives that are viscous at room temperature, as compared to conventional hot melt adhesives that are inherently solid at room temperature and become viscous only at elevated temperatures. Potential cold adhesives could be water or solvent based adhesives with suspended solids, and potentially rubber-based solvent and latex adhesives. Other adhesive applicator mechanisms also could be used as long as adequate adhesive is neatly and aesthetically printed according to manufacturing and quality guidelines.

Figure 10:
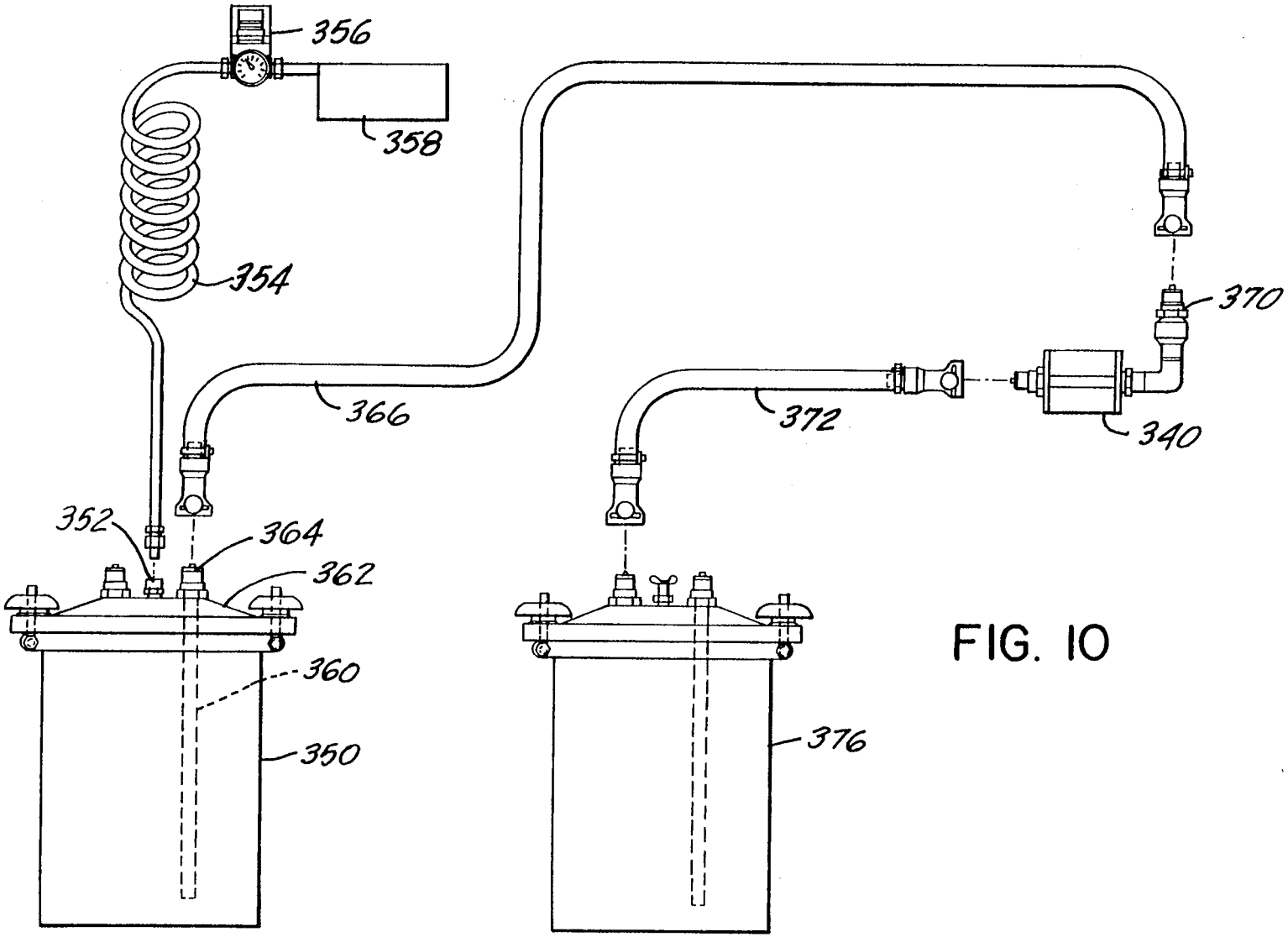
FIG. 10 is a schematic, exploded view of the cold adhesive supply system.

Referring now to FIG. 10, details of the adhesive supply system 300 are illustrated. This system 300 is a closed adhesive glue system that provides more controlled glue application along the gravure roller and provides for continual mixing of the adhesive which is viscous to prevent stagnation.

As illustrated in FIG. 11, the gravure roller 308 engages a frame mounted adhesive distribution block 340, having a cutout pocket 342 (FIGS. 14 and 15) of arcuate radius similar to the radius of the gravure roller 308. The adhesive distribution block 340 is supported on a support assembly of the frame (not shown) and includes biasing members 343 that bias the block 340 into the engagement with the gravure roller 308.

Figure 14:
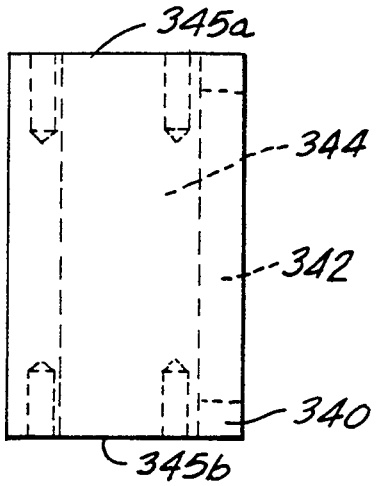
FIG. 14 is a plan view of the adhesive distribution block.
Figure 15:
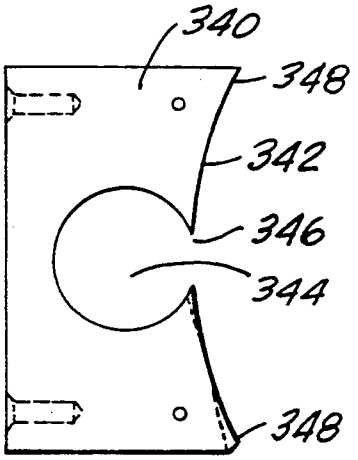
FIG. 15 is a side elevation view of the adhesive distribution block.
Figure 16:
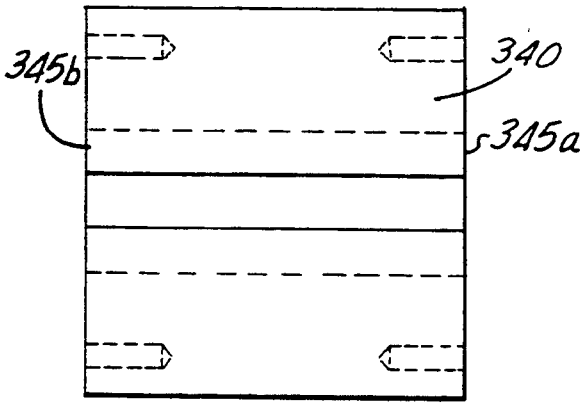
FIG. 16 is a front elevation view of the adhesive distribution block.
Figure 17:
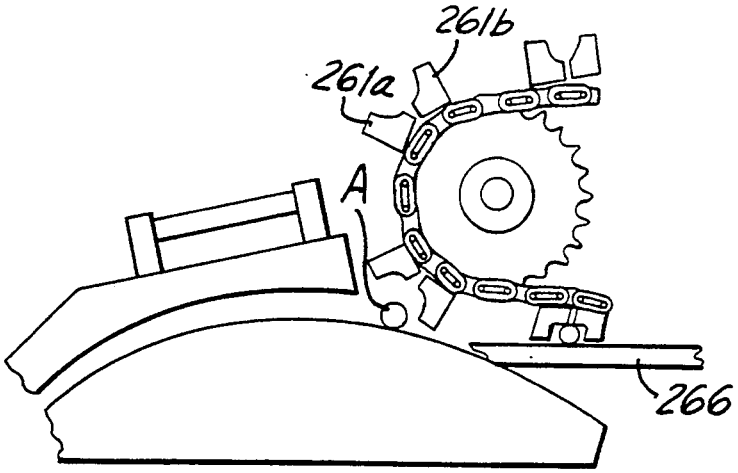
FIG. 17 is a schematic illustration of the lug chain used for discharging articles from the label transport drum.

The block 340 includes a central adhesive distribution channel 344 through which adhesive is pumped. The channel extends from one side of the block to the other and is positioned so that a longitudinal slot opening 346 is formed at the cutout pocket 342. The channel exits either side of the block, forming respective adhesive entrance and exit openings 345*a*, 345*b* (FIGS. 14 and 16).

As the adhesive is fed through the channel 344, the adhesive engages the rotating gravure roller 308 and transfers adhesive to the indentations on the gravure roller surface. The cutout pocket is dimensioned so that the gravure roller 308 provides a seal along the longitudinal slot opening 346 to prevent adhesive from dripping outward from the slot. Additionally, the cutout pocket 342 has beveled edges 348 that engage the gravure roller 308, removing the excess adhesive from the indentations. The beveled edges 348 perform the function of a doctor blade, which is now not necessary to include, saving space and facilitating adhesive control. Excess adhesive then flows back through the slot opening 346 and channel 344.

In the preferred aspect of the invention, the block 340 is biased against the gravure roller 308 so that the gravure roller 308 finds its own "seat" against the cutout pocket 342, the slot opening 346, and the beveled edges 348.

As shown in FIG. 10, the adhesive is stored within a closed pressurized tank 350, which is similar in construction to a pressurized paint tank. The tank 350 includes a pressure fitting 352 where a combination pressure line 354 and pressure regulator 356 connect between the fitting 352 and a source of pressurized air 358. The pressurized air (such as eight pounds over atmosphere) pushes down on the adhesive in a uniform manner, causing the adhesive to rise within a riser tube 360 extending from the paint tank cap 362 and the paint tank. The riser tube 360 extends into a fitting 364 on the tank cap 362. The rising adhesive then flows out of the paint tank into an adhesive delivery line 366 connected to the fitting 364 and to the distribution block 340 and distribution block fittings 370.

The adhesive flows through the channel 344, and into a return line 372, where the adhesive returns to a second tank 376, that is illustrated as a substantial duplicate of the first paint tank 350. The pressure, supply, and return lines 354, 366 and 372 can be easily switched onto respective tanks depending on which tank is full or empty with adhesive. This system also provides for closer control and delivery over the adhesive so as to reduce operating costs.

After the cold adhesive is applied to the area adjacent the leading edge of the label, a solvent application system, indicated generally at 170 (FIGS. 1 and 2), evenly applies solvent without mottling or solvent streaking in a precise pattern to the area adjacent the trailing edge of the label. The preferred solvent is an organic solvent and reacts to the film material. THF has been found to be an acceptable and desirable solvent.

The solvent reacts with the film material, dissolving a portion of the area adjacent the trailing edge to provide a tacky quality to that area, so that the trailing edge can be retained to the leading edge by a solvent-seal bond when the label is circumferentially wrapped around the article and the trailing edge overlaps the leading edge. Depending on the article used, and type of labeling, (such as forms of plastic articles), the trailing edge of the label can be positioned adjacent to, but not overlying the leading edge.

The solvent is preferably applied after the adhesive is applied, to ensure that the solvent does not evaporate before the trailing edge of the label has overlapped the leading edge. As illustrated, the solvent application system 170 is positioned ahead of the adhesive applicator 160 in the direction of drum rotation so that the leading edge of the label first engages the adhesive applicator 160, then the trailing edge of the label engages the solvent application system 170. This arrangement is preferred as compared to the reverse arrangement disclosed in the drawings of the copending parent application where the adhesive applicator is positioned after the solvent applicator, similar to the Dickey '760 patent.

Figure 18:
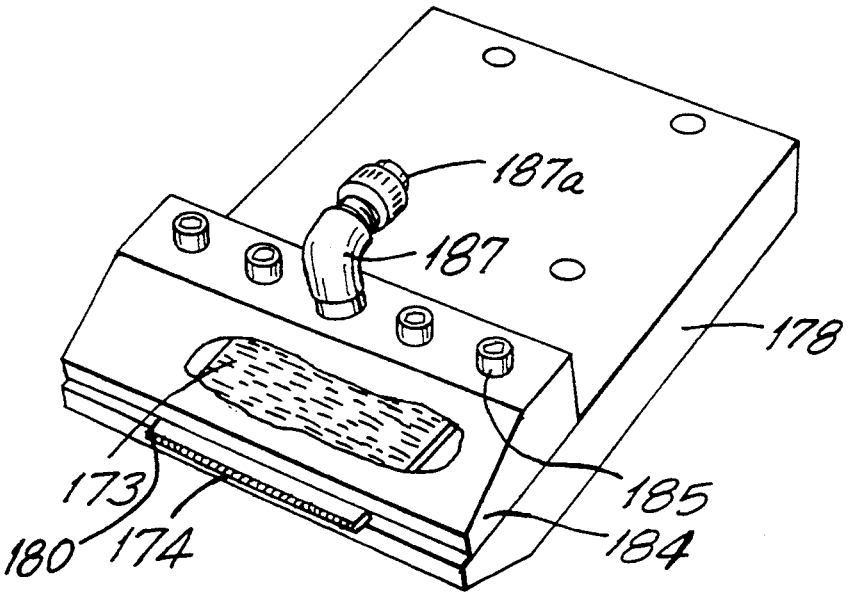
FIG. 18 is a perspective view of a solvent wiper assembly.

In the preferred, illustrated embodiment of FIG. 1, the solvent application system 170 includes two static wiper assemblies 172*a*, 172*b*, which are configured similar to each other. Each assembly supports a wiper body 173, having an outwardly extending wiper tip 174 (FIG. 18). In the illustrated embodiment, the wiper body is substantially rectangular configured with one end forming a wiper tip. The wiper tip can be thinner than the wiper body, tapered toward the end, or formed as another configuration such as a thin print pad as long as it is operable to apply solvent in a high quality wipe. The wiper body can be formed from felt or other similar porous material that absorbs solvent and then allows the solvent to flow to the wiper tip, such as by capillary action. The felt also is not reactive to the solvent. One material that has been found beneficial is a porous polyethylene such as manufactured by POREX Technologies, 500 Bohannon Road, Fairburn, Ga.

The first wiper assembly 172*a* (FIG. 2) cleans the trailing edge of the label—removing dirt and softening the trailing edge, by applying a minor amount of solvent sufficient only to clean and soften the area adjacent trailing edge of the label. This first solvent wipe in essence "etches" the area adjacent the trailing edge and acts as a pretreat to the label for further application of more solvent from another source. The second wiper assembly 172*b* applies the solvent that "bites" into the film so as to dissolve the solvent and form a tacky quality to the label and provide the welding action needed to secure the trailing edge in overlapping, secured solvent-seal relationship to the leading edge of the label when the label is wrapped about an article. Although two wiper assemblies are disclosed, it is still possible to use one wiper assembly for applying solvent when proper application conditions are established to ensure proper solvent-seal bonding.

Although the amount of applied solvent varies between the first and second wiper assemblies, it has been found sufficient that about twice as much solvent can be applied by the second wiper assembly 172*b* than the first wiper assembly 172*a*, first to clean and soften the label, and then form a tacky quality for a solvent-seal bond.

Additionally, the dual wiper assemblies 172*a*, 172*b* are advantageous because one type of solvent can be applied by the first wiper assembly 172*a*, and a second type of solvent different from the first type of solvent can be applied by the second wiper assembly 172*b*. The first solvent can be applied more for cleaning and etching the label, and the second solvent can be applied for dissolving the polymer to form a tacky area for a solvent-seal bond.

Each wiper assembly 172*a*, 172*b* is formed from a support housing structure which supports the wiper body 173. The support housing structure includes a lower, substantially rectangular configured support block 178 (FIGS. 2 and 18). In the illustrated embodiment, a wiper assembly support shaft 179 is secured at one end to the machine frame 23, and extends through parallel mounting blocks 179*a*, which are secured to the top surface of the support block 178 (FIG. 2). The mounting blocks 179*a* are free to rotate on the support shaft 179. The wiper assemblies can thus be pivoted in and out of a wiping position as desired. The construction can vary depending on the design selected by one skilled in the art. FIG. 2 illustrates one embodiment, while FIG. 18 illustrates yet another embodiment.

In the illustrated embodiment of FIG. 18, the upper surface of the support block 178 includes a cutout 180, which is configured for receiving the wiper body 173 therein on the top surface of the wiper body support block 178. The cutout 180 is formed open to the surface. A solvent channel (not shown) is formed on the top surface to receive solvent from the wiper body. A prismatic configured wiper retaining block 184 is secured by fastening means such as allen nuts 185 to the front portion of the support body 178 and engages the wiper body to retain the wiper body within the cutout area 180 and provide for feed of solvent. FIG. 18 shows a cut out portion to enhance the reader's understanding as the description proceeds.

A solvent delivery block 186 is positioned on top of the support block 178 and includes a solvent delivery fitting and orifice 187 which connects to a solvent delivery line 187*a*. The solvent delivery fitting and orifice 187 extends through the solvent delivery block 186 so that solvent delivered through the solvent delivery line 187*a* is drip fed by gravity onto the wiper body 173. A return line 189 (FIG. 19) extends upward via a bore in the support block 178 to communicate with the solvent channel.

Figure 19:
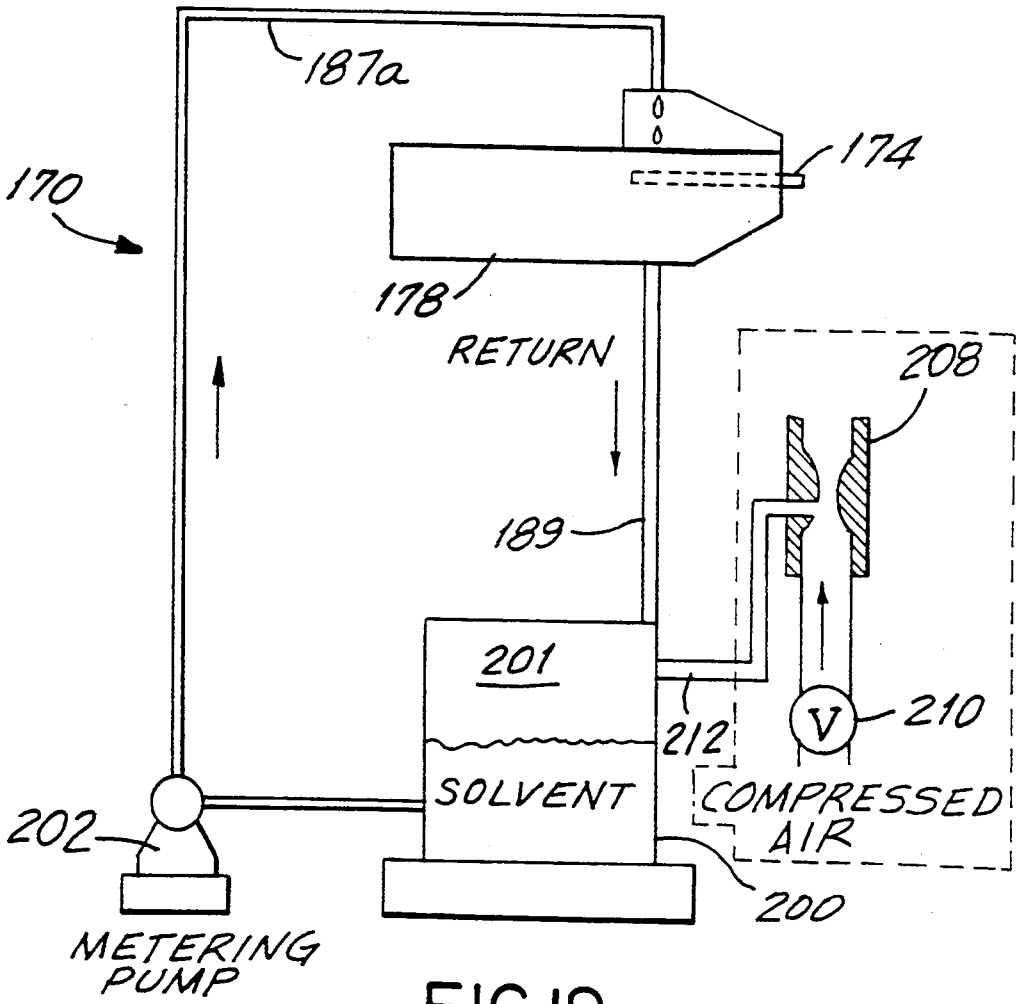
FIG. 19 is a schematic illustration showing the solvent delivery and vacuum scavenge system.

Referring now to FIG. 19, details of the solvent delivery system 170 and vacuum scavenge system are illustrated. In the preferred embodiment, each solvent wiper assembly 172*a*, 172*b* includes its own solvent delivery system and vacuum scavenge system so that each wiper assembly can be separately controlled.

Solvent is contained in the closed reservoir 200. The reservoir 200 includes a vacuum head space 201. A metering pump 202 draws solvent from the reservoir 200 and through the solvent delivery line 187*a* to the wiper assembly where the solvent is drip fed onto the wiper body. The solvent return line 189 connects to the top of the reservoir 200 in sealed relation thereto. A vacuum draw system, indicated at 206, is operatively connected to the solvent reservoir and applies a scavenge vacuum to the reservoir for regulating the subatmospheric pressure within the reservoir. As subatmospheric pressure within the reservoir is varied, the wiper body becomes more or less saturated as desired.

The vacuum draw system 206 includes flow control valving known under the designation Magnehelic. The system 206 generally includes a venturi 208 through which air flow is metered by means of a valve 210. A vacuum take-off line 212 extends form the venturi 208 to the closed reservoir. As the air pressure flowing through the venturi 208 is varied, the subatmospheric pressure in the reservoir 200 is varied. If more air passes through the venturi 208, subatmospheric pressure within the reservoir is lowered, causing the wiper body to become drier, thus reducing the amount of solvent at the tip. Less solvent would be transferred to the tip. The Magnehelic system can be adjusted to provide the amount of desired solvent supplied to the wiper body. Another type of scavenge vacuum system which may be used is disclosed in U.S. Pat. No. 4,844,760 to Trine, which is hereby incorporated by reference. It is possible to vary solvent in the wiper body from fully saturated to fully dry by varying subatmospheric pressure within the reservoir 200.

The solvent application system in another embodiment is illustrated schematically in FIG. 1A as 170', and includes a wiper member, indicated generally at 220, formed as a rotary printing head 222 that is mounted for rotation adjacent the label transport drum. The rotary printing head 222 includes two outwardly extending, flexible tips 224 that taper outward. The tips 224 are formed from a resilient material that is not highly reactive to the solvent. The tips 224 engage a solvent gravure roller 225. The flexible tips 224 are resilient to allow deflection of the tip against the label and drum surface, while retaining at least some stiffness to exert a wiping force against the label. Materials which may be used include felt, a cloth covering a felt wiper member, a soft cord, some silicones and urethanes, as well as other materials that are not highly reactive to the solvent, but have appropriate resilience for a rotating wiper.

By timing the maximum speed differential at the time the wiper tip is in contact with the trailing edge of the label, a wiping action can be produced. If the wiper tip is moving slower than the label transport drum, the solvent is wiped toward the trailing edge of the label. Conversely, if the wiper tip is moving faster than the label transport drum, the solvent is wiped from the trailing edge of the label forward. By timing the occurrence at the maximum speed differential points, the amount of wiping action can be varied. A directly driven elliptical gear arrangement has been found beneficial to provide the wiper speed differential that is timed with the label transport drum. The gears can also be set to yield an applicator surface speed equal to that of the label transport drum.

The speed differential between a wiper tip and label moving with the drum is maximized with the use of the static wiper assemblies 172*a*, 172*b* as described above.

Referring now to FIGS. 24 through 27, one preferred embodiment of the pressure applicator 22 is illustrated. The pressure applicator 22 of this illustrated embodiment has one control shaft that is turned for changing the biasing force exerted on the articles as they move on the label transport drum during article wrapping. For purposes of description, the elements of the pressure applicator are referred to in the 400 series. The pressure applicator illustrated in FIG. 2 is different from the embodiment to be described, such that the embodiment of FIG. 2 has a plurality of adjustable control shafts, as compared to the one control shaft in the illustrated embodiments of FIGS. 24 through 27.

As shown in FIG. 24, a support plate 430 fits between two upstanding, rectangular configured support mounts 400 that are received in slots 402 on the top surface of a pressure plate 434. The bolts are threaded and dimensioned with no clearance existing between the mounts 400 and the support plate 430. The pressure plate 434 pivots and moves relative to the mounts 400 for changing the camber of the pressure plate 434 relative to the more stable and fixed support plate 430 and surface of the label transport drum. The support plate 430 can also include a central bolt coupler 410 which extends through the plate.

As shown in FIG. 25, two spaced threaded control rods 420, 422, extend through the support plate 430. Each rod 420, 422, has a rounded end portion that engages a rod receiving indentation 431 positioned on the top surface of the pressure plate 434. As illustrated, the two rods 420, 422 are spaced so that each one engages a respective side of the pressure plate 434. Both control rods 420, 422 have right handed threads. The other ends of the control rods 420, 422 extend through the support plate 430. Each end has a spur gear 440*a*, 440*b* connected thereto, which intermesh with each other. A pinion gear 444 is supported on a shaft 446 (FIG. 24), which extends through a bore opening of the support plate 430. A cotter pin 450 or other means prevents the shaft 446 from disengaging from the bore opening. The pinion gear 444 engages one of the spur gears 440*a*. A control shaft 452 and universal joint assembly 454 are connected to the pinion gear 444.

A flange and movable bracket assembly 460 (FIG. 26) are slidably mounted on the frame. The support plate 430 is secured by means such as bolts 462 to the flange and movable bracket assembly 460. The support plate 430 and pressure plate 434 may move as one unit toward and away from the surface of the label transport drum.

In operation, the control shaft 452 is turned, Which rotates the pinion gear 444. For purposes of explanation, the pinion gear 444 could turn in the clockwise direction as shown in FIG. 27. The pinion gear 444 rotates the spur gear 440*a* in the reverse, counterclockwise direction. That spur gear 440 rotates the other, intermeshing spur gear 440*b* in the clockwise direction. Because both control rods are right handed threads, one control rod moves against the pressure plate 434, exerting more pressure against the plate, while the other control rod backs away, exerting less pressure. As a result the camber of the pressure plate 434 changes relative to the surface of the label transport drum.

Referring now to FIG. 1, details of the article delivery system are illustrated.

As shown in greater detail in FIG. 1, the drycells A are initially conveyed on a flat belt conveyor 230 and into a star transfer wheel 232. The star transfer wheel 232 rotates, transferring the drycells A sequentially into an inclined belt conveyor 234 to provide a sufficient head of drycells for process flow control. The drycells can be fed in a double row, side-by-side manner, each pair of drycells having complementary pairs of labels to be applied thereto. For purposes of illustration, the figures show only one row of fed drycells—the other row of article receiving positions on the star transfer wheel being empty. The apparatus can be readily designed for working with either one or two rows of fed drycells.

The belt conveyor transports the drycells A into an inclined gravity chute 236 having a serpentine channel 238 for slowing the movement of the drycells A from the height of the inclined belt conveyor. The drycells A then are fed into a serpentine timing wheel assembly, indicated generally at 240, where a tangential, rotative movement is imparted to the drycells A. The drycells A traverse around the serpentine timing wheel assembly 240, which includes three star transfer wheels 240*a*, 240*b*, 240*c* mounted on spindles connected to the frame (FIGS. 2). Each transfer wheel has article receiving positions 242 (FIG. 2) for holding and conveying the drycells.

The star transfer wheels 240*a*, 240*b*, 240*c* accelerate movement of the drycells from one transfer wheel to the next. Each succeeding transfer wheel has fewer article receiving positions 242, thus requiring each succeeding transfer wheel to rotate faster.

As shown in FIG. 20, the first transfer wheel 240*a* includes more positions than the third transfer wheel 240*c*. Thus, the transfer wheels increase in rotational speed from the first to the third wheel, accelerating movement of the drycell. As a drycell leaves the third star transfer wheel 240*c*, the drycell engages the article entrance area 250 of the downwardly inclined pressure plate 446 of the pressure applicator 22, which imparts a spin to the drycell to aid in moving the article into tangential spinning engagement with the surface of the label transport drum 20 (FIG. 2).

Figure 21:
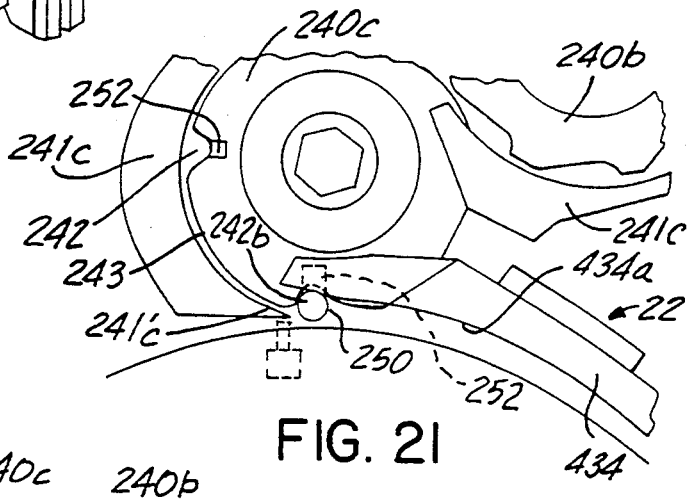
FIG. 21 is a schematic side elevation view of the third star transfer wheel and the pressure plate.

Each star transfer wheel 240*a*, 240*b*, 240*c* includes a shield 241*a*, 241*b*, 241*c* (FIG. 1) which is spaced from the other periphery of the respective star transfer wheel to form an article channel 243 having an inner article engaging surface 243*a* which the drycells engage (FIG. 21). The shields 241*a*, 241*b*, 241*c* prevent the drycells from spinning out of the article receiving position 242 due to centrifugal forces exerted against the drycell.

As best shown in FIG. 21, the third star transfer wheel 240*c* and its shield 241*c* are spaced outward from the surface of the label transport drum 20 to ensure that the plunger 132 does engage the star transfer wheel 240*c* or its shield 241 as the drum rotates.

As best shown in FIGS. 21 through 23, the pressure plate 434 has a cutout 435 in which the third star transfer wheel 240*c* is received. As the drycell moves around the third star transfer wheel, 240*c*, it enters the article entrance area 250 and engages the lower article engaging surface 434*a* of the pressure plate 434 (FIG. 21).

This spacing at the article entrance area 250 between the shield 241*c* and drum surface, however, creates a drop-off for the drycell onto the label transport drum, which results in the drycell dropping onto the label or drum surface causing crimping of the label and poor quality seams during wrap around labeling.

In accordance with the present invention, at least one neodymium magnet 252 is positioned at each article receiving position 242 for imparting attractive magnetic forces onto the drycell A to aid in smooth, tangential delivery of the drycells onto the drum surface and into engagement with a label positioned at the article wrapping position 21. The magnet can be positioned flush with the surface of the star transfer wheel so it will not interfere with the drycell received in the article receiving position. In one aspect of the invention, two magnets are positioned at each article receiving position.

As best illustrated in FIG. 21, the magnet 252 is positioned so that it directs the attractive forces on the article in a direction away from the label transport drum 22. As the drycell reaches the article entrance area 434, the magnet retains the drycell onto the edge 242*b* of the article receiving position 242 while the edge 242*b* pushes the drycell along the lower article engaging surface 434*a* of the pressure plate 434.

The lower article engaging surface 434*c* is disposed downward toward the drum surface so that the article entrance area 250 has a diameter larger than that of the drycell. Thus, as the edge of the pocket 242 pushes the drycell along the lower article engaging surface 434*a*, the drycell is stripped off the edge and moves smoothly and tangentially into contact with the drum surface. In one aspect of the invention, the article engaging surface 434*a* forms an arcuate curve disposed outwardly from the drum surface at the article entrance area 434 to aid in imparting rotative spin to the drycell as the drycell initially engages the article engaging surface.

For the described "AA" size dry cell, weighing 0.5 ounces, a magnet that draws an attractive magnetic force of four pounds has been found sufficient to control drycell feed and ensure smooth, tangential delivery. Two magnets of that type have been found even more beneficial. Additionally, it is possible to choose the amount of attractive magnetic force relative to the weight of the article so that as the transported dry cell reaches the point adjacent to the label transport drum, the magnetic forces biases the article in a direction relative to the label transport drum to deliver a drycell more smoothly and tangentially onto the drum surface. This may be beneficial if the advantageous pressure plate is not used to help strip dry cells from the article receiving portions of the star transfer wheel. The attractive forces, whether magnetic or vacuum induced, could be manipulated to ensure smooth, tangential delivery.

Figure 21A:
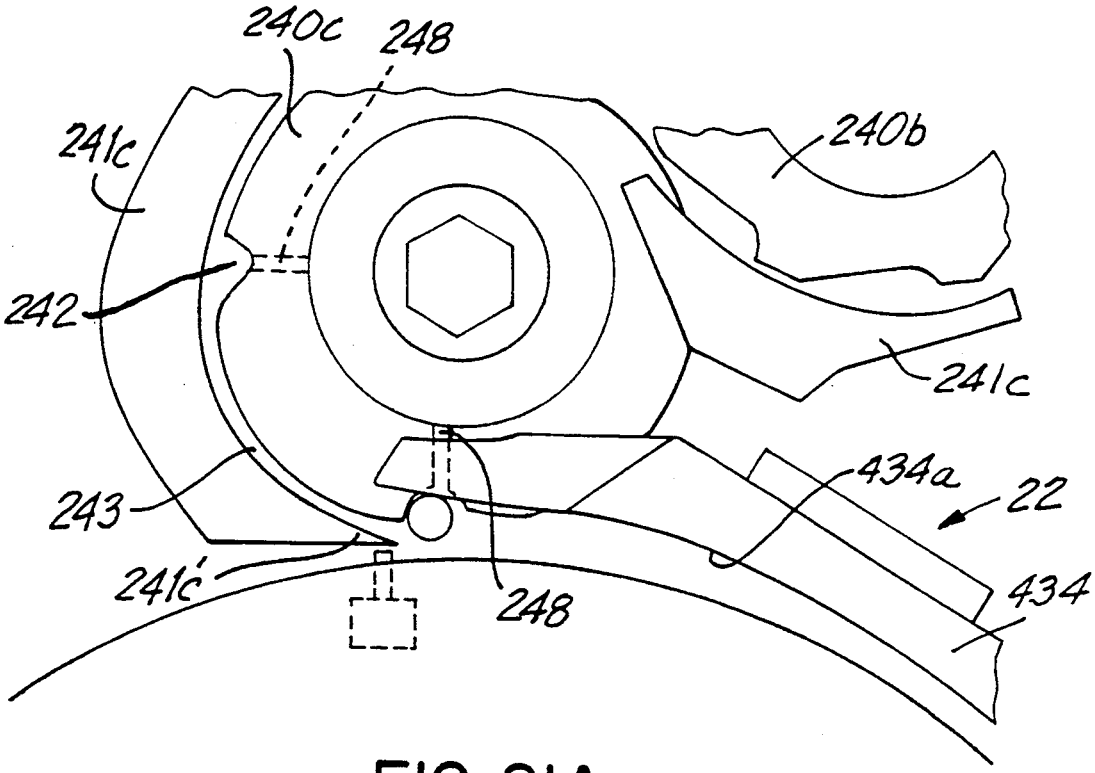

FIG. 21*a* illustrates yet another embodiment where vacuum is drawn through vacuum orifices 248 positioned at each article receiving position 242. Vacuum can be drawn by any suitable means that those skilled in the art can construct. The vacuum draw system descried is especially useful for nonmetallic materials, such as plastic tubes and articles. These articles are typically lighter than the described dry cells and a vacuum draw can be sufficient to retain the article against the surface 434*a* as long as proper vacuum holes or other means are provided when necessary in the plate 434. Naturally, the amount of drawn vacuum can be varied to allow sufficient draw on the article to bias the article in a direction to allow smooth, tangential delivery thereon even when a pressure plate is not present to aid in stripping articles into smooth, tangential delivery onto the surface of the label transport drum.

An endless lug chain assembly, indicated generally at 260 (FIG. 1) is positioned adjacent the label transport drum at a position where the dry cells would initially fall from the label transport drum 20, at the point adjacent to the end of the pressure plate where the dry cells exit therefrom. The lug chain assembly 260 includes pairs of complementary article engaging grips 261*a*, 261*b* that are fixed to the lug chain. As the lug chain and complementary pairs of grips 261*a*, 261*b* rotate into close relation to each other and to the end of the pressure plate (FIG. 11), the grips 261*a*, 261*b* engage a dry cell and move the dry cell onto a conveyor, positioned tangent to the drum surface. Alternatively, a series of star transfer wheels could be used to remove drycells from the surface of the drum. FIG. 2 illustrates one star wheel arrangement. It has been found, however, that the described lug chain 260 is advantageous for its intended purpose, and less complex than the star transfer wheel, which could misdeliver drycells from one wheel to the other.

METHOD OF OPERATION

In operation a strip 28 of label material is fed from the label supply roll 26*a*, through the dancer roll assembly 32 and into the off-drum cutting mechanism 42 (FIG. 1). The film is advanced such that label cutting occurs at the trailing edge and each cut label is transferred to the label areas on the label transport drums 20. Vacuum is drawn within the first and second vacuum manifolds 114, 126 and through the first and second plenums 104, 120 and orifices 106, 122 to retain the label on the drum surface. During labeling, the controller 36 ensures constant film .withdrawal without intermittent film feed, thus minimizing motor spikes and inaccurate start-stop operation.

As the label moves with the drum 20, the label moves opposite the adhesive applicator 160 where an adhesive is printed onto the area adjacent the leading edge 21*a*. As the drum continues its rotation, the trailing edge moves adjacent the wiper members. The spring biased plunger 132 has pushed the trailing edge of the label outward from the drum surface. As a result, the outwardly biased trailing edge of the label engages the outwardly extending wiper tips 174, so as to apply a predetermined amount of solvent on the trailing edge of the label.

The drycells "A" move from the flat belt conveyor 230 and into the star transfer wheel 232. The star transfer wheel 232 rotates, transferring the articles A one at a time into the inclined belt conveyor 234 and into the inclined gravity chute 236. The drycells A then are fed into the serpentine timing wheel assembly 240, where the tangential, rotative movement is imparted to the drycells A, while the drycells A traverse around the three transfer wheels 240*a*, 240*b*, 240*c*. In accordance with the present invention, the magnet 252 holds the drycells against the pressure plate 434 thus, allowing tangential delivery onto the drum surface.

The star transfer wheels also accelerate movement of the drycells into contact with the surface of the drum. As a drycell leaves the third transfer wheel 240*c*, the drycell engages the article entrance area 250 of the pressure plate 434, which imparts a spin to the drycell while the magnetic forces imparted on the drycell retain the drycell onto the lower article engaging surface. As the drycell moves along the article engaging surface, it then moves into tangential spinning engagement with the surface of the label transport drum 20 (FIG. 2).

At the article wrapping position 21, the leading edge of the label is blown upward away from the drum surface by means of pressurized air blowing from the first pressure manifold 114 and through the orifices 106 of the label retaining insert plate 100. The adhesive on the leading edge forms a "tack" bond on the drycell which has been delivered, tack bonding the label to the article. Typically, the drycells moves slow, and the label on the drum engages the drycell.

As the article rolls, the label is rolled upward against the body of the drycell and the vacuum seal between the label L and the surface of the drum is broken. Thus, the vacuum drawn in the second vacuum manifold and through the orifices engaging the midportion and trailing edge of the label is broken to allow complete article wrapping. This action is similar to the opening of a "sardine can." The drycells A traverse along the drum surface, held to the surface by means of the pressure plate 434, which also acts as a retaining shield. The label transport drum 20 rotates faster than the spinning drycells, imparting and maintaining spin to the drycells A. Because the drum is rotating faster than the spinning drycells A, the leading edge of the label moves into engagement with a drycell A at the article wrapping position 21.

If an drycell misfeeds at the article wrapping position, the leading edge does not engage the drycell, and the label is retained by the vacuum drawn in the second vacuum manifold 126 to the drum surface past the article wrapping position 21. The label continues moving with the rotating drum into a label blow-off position 127 where the vacuum holding the label to the drum surface ceases. A pressurized blow of air onto the label from the pressure manifolds 128, 129 forces the label from the drum surface.

If the labels are mismatched, i.e., the ends are unaligned (FIG. 30A), the control rod 454 (FIG. 24), of the pressure applicator 22 is adjusted to change the camber of the pressure plate 434 engaging the drycell to impart the desired pressure against selected sides and ends of the drycell so that the label is aligned correctly on each drycell as they are wrapped (FIG. 30B).

As the drycell continues its rotation around the drum surface, the drycell then is removed by the serpentine lug chain assembly 260 (FIG. 1) which transfers the drycells onto the flighted bed belt conveyor 266.

The conveyor 266 transports the drycells into an oven 267 where the articles are heated overall and the label film heat shrunk around the drycells A. A manual swing arm assembly 270 supports a modular control unit 272 (FIG. 1) providing access for a user to the machine controls. In one embodiment the modular control unit is a GE Fanuc mini O.I.T. Touch screen operatively connected to the controller 36. In another embodiment (not illustrated), the article discharge area has a lug chain, and not a timing wheel assembly.

The smaller size drycells used with the present invention range in size from typically about 0.5 to 1.75 inches in diameter, and about 2.25 inches long (for a 1.5 inch "D" size battery) and about 0.375 inches diameter and 1.675 inches long for an AAA size battery. The above description has proceeded relative to "AA" size drycells, i.e., slightly greater than 0.5 inch diameter, two inches long, and about 0.5 ounces.

The drycells have opposing, substantially planar end portions forming a shoulder 290 at the intersection of the outer peripheral surface of the drycell and the end portions. As shown in FIG. 31, the label, before it is wrapped, is substantially rectangular configured with leading and trailing edges (30A and 30B). A major portion of the label is covered with printed matter and ink (indicated by the central striped pattern). The portions of the label adjacent the leading and trailing edges of the label are substantially void of printed matter and ink, and the label portion adjacent the trailing edge has a greater area that is void of printed matter and ink than the portion adjacent the leading edge. The trailing edge portion void of printed matter and ink is typically about 0.10 to 0.25 inches wide.

Typically these dimensions are constant for most drycell battery sizes such as "AAA" to "D" size drycell batteries. Naturally, the dimensions can vary depending on the article, label, and desired quality. This area receives the solvent without causing ink spread and dissolving such as would occur if the printed matter and ink were continued to the trailing edge of the label. As illustrated, the label and the label areas adjacent the shoulders are heat shrunk over the shoulders. The leading edge includes an adhesive.

A small cylindrical drycell battery that has been labeled in accordance with the present invention is illustrated as a size "AA" battery in FIGS. 30A and 30B.

The apparatus and method of the present invention provides numerous benefits. Small cylinder articles, especially those heavier articles such as magnetically attractive drycells, can be smoothly and tangentially delivered onto a label transport drum from a position spaced outward from the drum surface. Thus, the outwardly extended plunger engaging the trailing label edge is not distributed and labeling is more exact. Additionally, a viscous cold adhesive is delivered in a controlled manner onto the print pad of a rotary pad print head without having the adhesive becomes stagnant in delivery lines, such as could occur during slow production periods. Also, labels are cut off-drum in a precise manner and accurately transferred onto predetermined label areas of a label transport drum for wrap around labeling of articles that are typically less than 1.75 inches in diameter.

It should be understood that the foregoing description of the invention is intended merely to be illustrative thereof, and that other embodiments, modifications and equivalents may be apparent to those skilled in the art without departing from its spirit.

That which is claimed is:

1. An apparatus for applying a label onto a small cylindrical article comprising, a label transport drum that defines a central axis, means for supplying a label onto the surface of said drum, means for rotating said drum about its axis so that the label moves with the drum into an article wrapping position, and means for delivering small cylindrical articles from a position that is spaced outward from the drum surface into engagement with the drum and the label as the label moves into the article wrapping position for wrap around labeling, and including means spaced outward from the label transport drum for imparting an attractive force on the article in a direction that aids in smooth, tangential delivery of articles onto the drum surface and into engagement with a label positioned at the article wrapping position.

2. An apparatus according to claim 1 wherein the delivered articles are less than about 1.75 inches in diameter.

3. An apparatus according to claim 1 wherein said attractive force imparting means comprises means for drawing a vacuum onto said article to attract said article in a direction away from the drum.

4. An apparatus according to claim 1 wherein said articles are magnetically attractive and said force imparting means comprises means for imparting attractive magnetic forces onto said article.

5. An apparatus according to claim 4 wherein said magnetic force imparting means is positioned for imparting attractive forces on the article in a direction away from the label transport drum.

6. An apparatus according to claim 4 wherein said article delivery means comprises a star transfer wheel mounted adjacent said label transport drum and having at least one article receiving pocket, and said magnetic means comprises at least one magnet positioned adjacent said article receiving pocket.

7. An apparatus according to claim 6 wherein said magnet comprises a neodymium magnet.

8. An apparatus according to claim 1 including an article engaging surface spaced from said drum surface adjacent the article wrapping position for engaging delivered articles and applying pressure thereto, said article engaging surface defining an article entrance area that is disposed a distance greater than the diameter of the articles, and wherein said attractive force imparting means retains articles onto the article engaging surface during article delivery into said article entrance area so that the articles move along the article engaging surface into smooth, tangential engagement with the drum surface.

9. An apparatus according to claim 8 wherein said article engaging surface forms an arcuate curve disposed outwardly from the drum surface of the article entrance area to aid in imparting rotative spin to the article as the article initially engages the article engaging surface.

10. An apparatus according to claim 9 wherein said article engaging surface comprises a pressure plate.

11. An apparatus according to claim 8 wherein said article delivery means initially pushes said article along said article engaging surface during delivery into said article entrance area.

12. An apparatus according to claim 3 wherein the generated magnetic force is about eight times the weight of the article.

13. An apparatus for applying a label onto a small cylindrical article comprising, a label transport drum that defines a central axis, means for supplying a label onto the surface of said drum, means for rotating said drum about its axis so that the label moves with the drum into an article wrapping position, means for applying an adhesive onto an area adjacent the leading edge of the label while the label is moving with said drum, wiper means spaced outward from the drum surface, means for positioning the trailing edge of the label outwardly from the drum surface for engaging said wiper means so that a predetermined amount of solvent is applied onto the trailing edge of the label, and means for delivering a small cylindrical article into tangential spinning engagement with the drum and into rotative engagement with the label as the label moves into the article wrapping position for wrap around labeling, said article delivering means being spaced outward from the drum surface a distance sufficient to allow clearance between said article delivery means and said biasing means during drum rotation, and including means spaced outward from the label transport drum for imparting attractive forces on the article in a direction that aids in smooth, tangential delivery of the article onto the drum surface and into engagement with a label positioned at the article wrapping position.

14. An apparatus according to claim 13 wherein said means for imparting attractive forces comprises means for drawing a vacuum on the cylindrical article as it is delivered onto said drum.

15. An apparatus according to claim 13 wherein said article is magnetically attractive and said means for imparting attractive forces on the article comprises means for imparting magnetic forces.

16. The apparatus according to claim 13 wherein the articles are magnetically attractive and said delivery means comprises a star transfer wheel mounted adjacent said label transport drum and having at least one article receiving position, and said force imparting means comprises at least one magnet positioned adjacent said article receiving position.

17. An apparatus according to claim 16 wherein said magnet comprises a neodymium magnet.

18. The apparatus according to claim 13 including an article engaging surface spaced from said drum surface adjacent the article wrapping position for engaging delivered articles and applying pressure thereto, said article engaging surface defining an article entrance area that is disposed a distance from the drum greater than the diameter of the articles, and wherein said attractive force imparting magnet means retains articles onto the lower article engaging surface during article delivery into said article entrance area so that the articles move along the article engaging Surface into smooth, tangential engagement with the drum surface.

19. An apparatus according to claim 18 wherein said article engaging surface comprises a pressure plate.

20. An apparatus according to claim 18 wherein said article engaging surface forms an arcuate curve disposed outwardly from the drum surface at the article entrance area to aid in imparting rotative spin to the article as the article initially engages the article engaging surface.

21. An apparatus according to claim 18 wherein said article delivery means initially pushes said article along said article engaging surface during delivery into said article entrance area.

22. An apparatus according to claim 13 wherein said positioning means comprises a plunger extending into the drum and means for biasing the plunger outward from the drum surface.

23. An apparatus according to claim 22 wherein said plunger includes an end portion having an upwardly inclined surface in the opposite direction of drum rotation and a substantially flat, land portion following the upwardly inclined surface.

24. An apparatus according to claim 15 wherein the generated magnetic force is about eight times the weight of the article.

25. An apparatus according to claim 13 wherein the articles are less than about 1.75 inches in diameter.

26. An apparatus for applying a thin film, heat shrinkable polymer label onto a drycell battery comprising, a label transport drum that defines a central horizontal axis, means for supplying a thin film, heat shrinkable polymer film label having a thickness less than 0.035 inches to the surface of said drum, means for rotating said drum about its horizontal axis so that the label moves with the drum into an article wrapping position, means for applying an adhesive onto an area adjacent the leading edge of the label while the label is moving with said drum, wiper means spaced outward from the drum surface, means for positioning the trailing edge of the label outwardly from the drum surface for engaging said wiper means and wiping a predetermined amount of solvent onto the trailing edge of the label, and means for delivering a drycell battery having a diameter less than about 1.75 inches into engagement with the drum as the label moves into the battery wrapping position for wrap around labelling, said delivery means having a battery discharge area that is spaced outward from the drum surface a distance sufficient to allow clearance between said battery delivery means and said biasing means during drum rotation, and including means spaced outward from the label transport drum for imparting magnetic forces on the battery in a direction that aids in smooth, tangential deliverance of the battery onto the drum surface and into engagement with a label positioned at the battery wrapping position.

27. The apparatus according to claim 26 wherein said battery delivery means comprises a star transfer wheel mounted adjacent said label transport drum and having at least one battery receiving position, and said magnetic means comprises at least one magnet positioned at said battery receiving position.

28. An apparatus according to claim 27 wherein said magnet comprises a neodymium magnet.

29. The apparatus according to claim 27 including a pressure plate having a battery engaging surface spaced from said drum surface adjacent the battery wrapping position a distance for engaging delivered batteries and applying pressure thereto, said battery engaging surface defining a battery entrance area that forms an open area greater than the diameter of the delivered batteries, said battery engaging surface being disposed toward the label transport drum and wherein said magnet means is positioned to retain the batteries onto the battery engaging surface during battery delivery into the article entrance area so that the batteries move along the battery engaging surface into smooth, tangential engagement with the drum surface.

30. An apparatus according to claim 29 wherein said pressure plate includes a cutout at the battery entrance area for receiving a portion of said star transfer wheel, wherein said pressure plate engages a battery held within a battery receiving pocket as the star transfer wheel rotates so as to remove the battery from the battery receiving pocket.

31. An apparatus according to claim 29 wherein said pressure plate forms an arcuate curve disposed outward from the drum surface at the battery entrance area to aid in imparting rotative spin to the battery as the battery initially engages the battery engaging surface.

32. An apparatus according to claim 29 wherein said battery delivery means initially pushes said battery along the battery engaging surface during delivery into said article entrance area.

33. An apparatus according to claim 26 wherein said positioning means comprises a plunger extending into the drum and means for biasing the plunger outward from the drum.

34. A method for applying a label onto a small cylindrical article comprising:

feeding a label onto the surface of a horizontally disposed label transport drum while rotating the drum about its horizontal axis so as to move the label with the drum into an article wrapping position, applying an adhesive onto an area adjacent the leading edge of the label, positioning the trailing edge of the label outwardly from the drum surface and engaging the trailing edge with a wiper that is spaced outward from the drum surface so that a predetermined amount of solvent is applied onto the trailing edge of the label when the trailing edge of the label engages the wiper, and delivering small cylindrical articles into tangential spinning engagement with the drum and into rotative engagement with the label, while also imparting attractive forces onto the article in a direction such as to aid in smooth, tangential deliverance of the article onto the drum surface and into engagement with a label positioned at the article wrapping position.

35. A method according to claim 34 wherein the articles are magnetically attractive and including the step of applying magnetic forces onto the article to create an attractive biasing force on the article to ensure smooth, tangential delivery of the article onto the surface of the label transport drum.

36. The method according to claim 35 wherein magnetic forces are imparted in a direction away from the label transport drum.

37. A method according to claim 34 including the further step of magnetically retaining the article against the article engaging surface of a pressure plate which is disposed toward the drum so that the article is smoothly and tangentially delivered onto the label transport drum.

38. A method according to claim 34 including drawing a vacuum onto the article for exerting a biasing force on the article in a direction to assist in smooth tangential delivery of the article onto the drum surface.

39. A method according to claim 38 including the further step of retaining by vacuum the article against the article engaging surface of a pressure plate which is disposed toward the drum so that the article is smoothly and tangentially delivered onto the label transport drum.

40. A method according to claim 34 wherein the step of positioning the trailing edge outward from the label transport drum includes the step of biasing the trailing edge outward from the drum with a spring biased plunger.

41. A method for feeding a small, magnetically attractive cylindrical article onto a label transport drum for wrap around labeling comprising the steps of delivering a small magnetically attractive cylindrical article from a position spaced outward from the surface of a label transport drum while imparting magnetic forces spaced outward from the label transport drum onto the article in a direction such as to aid in smooth, tangential deliverance of the article onto the drum surface.

42. A method according to claim 41 including the step of creating a biasing force on the article during delivery onto the label transport drum by magnetically biasing the article in a direction away from the surface of the label transport drum.

43. A method according to claim 42 including the step of magnetically retaining the article against the article engaging surface of a pressure plate which is disposed toward the drum so that the article is smoothly and tangentially delivered onto the label transport drum.

44. A method according to claim 43 wherein the label transport drum is disposed with a horizontal axis.

45. A method for feeding a small cylindrical article onto a label transport drum for wrap around labeling comprising the steps of delivering small cylindrical articles from a position spaced outward from the surface of a label transport drum while imparting attractive forces spaced outward from the label transport drum onto the articles in a direction so as to aid in smooth, tangential deliverance of the article onto the drum surface.

46. A method according to claim 45 including drawing a vacuum onto the article for biasing the article in a direction to aid-in smooth, tangential delivery.

47. A method according to claim 46 wherein the articles are magnetically attractive and including the step of imparting magnetic forces onto the article to bias the article into smooth, tangential delivery onto the label transport drum.

* * * * *

UNITED STATES PATENT AND TRADEMARK OFFICE

CERTIFICATE OF CORRECTION

PATENT NO. : 5,405,487

DATED : April 11, 1995

INVENTOR(S) : John M. Galchefski
Ian Westbury

It is certified that error appears in the above-indentified patent and that said Letters Patent is hereby corrected as shown below:

On the title page: Item [75]

At number [75], change "Jan Westbury" to --Ian Westbury--.

Col. 16, line 3, "The pressure applicator 21" change to --The pressure applicator 22--.

Col. 17, line 16, after "port openings" add --150--.

Signed and Sealed this

Twenty-seventh Day of June, 1995

Bruce Lehman

*Attest:*

BRUCE LEHMAN

*Attesting Officer*

*Commissioner of Patents and Trademarks*